US009892810B2

(12) United States Patent
Kwerreveld

(10) Patent No.: US 9,892,810 B2
(45) Date of Patent: Feb. 13, 2018

(54) COLLIMATOR SHUTTER DRIVE MECHANISM

(71) Applicant: CLAYMOUNT ASSEMBLIES B.V., Dinxperlo (NL)

(72) Inventor: Robert Kwerreveld, Lichtenvoorde (NL)

(73) Assignee: CLAYMOUNT ASSEMBLIES B.V., Dinxperlo (NL)

( * ) Notice: Subject to any disclaimer, the term of this patent is extended or adjusted under 35 U.S.C. 154(b) by 157 days.

(21) Appl. No.: 15/058,055

(22) Filed: Mar. 1, 2016

(65) Prior Publication Data

US 2017/0256329 A1 Sep. 7, 2017

(51) Int. Cl.
*G21K 1/04* (2006.01)
*G21F 1/08* (2006.01)

(52) U.S. Cl.
CPC ..... *G21K 1/046* (2013.01); *G21F 1/085* (2013.01)

(58) Field of Classification Search
CPC ..... G21K 1/046; G21F 1/085
USPC ..... 378/147–153; 250/505.1
See application file for complete search history.

(56) References Cited

U.S. PATENT DOCUMENTS 3,829,701 A * 8/1974 Hura ..... G03B 42/02 378/153
3,947,690 A * 3/1976 Peyser ..... A61B 6/06 378/153
4,246,488 A * 1/1981 Hura ..... G21K 1/04 378/151
4,389,730 A * 6/1983 Cutter ..... G21K 1/04 378/152

OTHER PUBLICATIONS

Siemens "ML03 X-ray Collimator Data Sheet," webpage http://www.oem-products.siemens.com/x-ray-collimator or http://static.healthcare.siemens.com/siemens_hwem-hwem_ssxa_websites-context-root/wcm/idc/groups/public/documents/download/mda1/mti0/~edisp/data-sheet-ml03_2014_10-02004596.pdf, accessed Mar. 1, 2016.

Siemens "Multileaf Collimator AL 01 II, AL 02 II, AFL 01 II, and AF 01 II," webpage https://www.yumpu.com/en/document/view/19396362/data-a101-a102-af01-af101-oem-versb-siemens, accessed Mar. 1, 2016.

* cited by examiner

*Primary Examiner* — Courtney Thomas
(74) *Attorney, Agent, or Firm* — Maschoff Brennan

(57) ABSTRACT

Technology is described for a collimator assembly for a radiation collimator. In one example, the collimator assembly includes a base and a shutter assembly. The shutter assembly includes a lower shutter and a shutter control. The lower shutter includes a yoke, a control pin, and an inner extension extending from a first end of the yoke and supports the control pin. The shutter control includes a ramp feature that is slidably engaged with the control pin. The yoke rotates as the control pin slides along the ramp feature, and the shutter control is slidably engaged with the base.

21 Claims, 16 Drawing Sheets

COLLIMATOR SHUTTER DRIVE MECHANISM

BACKGROUND

Unless otherwise indicated herein, the approaches described in this section are not prior art to the claims in this disclosure and are not admitted to be prior art by inclusion in this section.

An x-ray system typically includes an x-ray tube and a detector. The power and signals for the x-ray tube can be provided by a tube generator. The x-ray tube emits radiation, such as x-rays, toward an object. The object is positioned between the x-ray tube and the detector. The radiation typically passes through the object and impinges on the detector. As radiation passes through the object, internal structures of the object cause spatial variances in the radiation received at the detector. The detector then generates data based on the detected radiation, and the system translates the radiation variances into an image, which may be used to evaluate the internal structure of the object, such as a patient in a medical imaging procedure or an inanimate object in an inspection scan.

The radiation detector (e.g., x-ray detector) can include a conversion element that converts an incoming radiation beam into electrical signals, which can be used to generate data about the radiation beam, which in turn can be used to characterize an object being inspected (e.g., the patient or inanimate object). In one example, the conversion element includes a scintillator that converts a radiation beam into light, and a sensor that generates electrical signals in response to the light. The detector can also include processing circuitry that processes the electrical signals to generate data about the radiation beam.

In some configurations, a collimator can be positioned between the x-ray tube and the object. The collimator can adjustably narrow the radiation beam to a specific area of interest on the object. The technology (devices, systems, and methods) described herein provides collimator solutions to adjust the radiation beam from a radiation source.

BRIEF SUMMARY OF SOME EXAMPLE EMBODIMENTS

A collimator is a device that narrows a beam of particles or waves (e.g., x-ray radiation) so the directions of motion becomes more aligned in a specific direction or the spatial cross section of the beam becomes smaller (i.e., a beam limiting device). Collimators used to limit x-ray radiation can have features that include materials (e.g., lead [Pb]) to absorb or block radiation. Collimators can include various structures, shapes, sizes, and mechanisms for different application. Collimators can limit the x-ray beam to a specific region of interest (e.g., examination area or a treatment area) or improve image quality by reducing x-ray scattering. Collimator can be used to reduce exposure of patient tissue from x-ray radiation that is outside the target area, which can be beneficial to the patient by reducing the total x-ray dose to the patient (or operator). Collimators can be used in various applications, such as radiological imaging and therapy, computed tomography (CT), fluoroscopy, and mammography.

A collimator can have a drive mechanism that uses ramps and control pins to pivot shutter pairs in a collimator assembly. The use of the drive mechanism can provide a compact design (e.g., in height) of the shutters. In an example, a collimator assembly includes a base and a shutter assembly. The shutter assembly includes a lower shutter and a shutter control. The lower shutter includes a yoke, a control pin, and an inner extension extending from a first end of the yoke and supports the control pin. The shutter control includes a ramp feature that is slidably engaged with the control pin. The yoke rotates or tilts as the control pin slides along the ramp feature and the shutter control is slidably engaged with the base.

In another example, the shutter assembly further includes a first shutter bracket attached to the base and a second shutter bracket attached to the base. The lower shutter further includes an outer extension extending from a second end of the yoke, an outer hinge pin supported by the outer extension and the second shutter bracket, and an inner hinge pin supported by the inner extension and the first shutter bracket. The outer hinge pin is hingedly engaged with the outer extension or the second shutter bracket. The inner hinge pin is hingedly engaged with the inner extension or the first shutter bracket.

In another configuration, the base includes an opening (i.e., a hole) and the shutter assembly further includes an upper shutter with a lower end that is in communication with the lower shutter. Communication refers to being coupled to, adjacent to, or in close proximity to a component (e.g., lower shutter) through direct contact or attached via another medium (e.g., shutter base). A majority of the upper shutter has a substantially planar shape. The upper shutter rotates or tilts with the rotation of the yoke of the lower shutter and the rotation of the upper shutter is configured to variably block radiation from passing through the opening. The upper shutter can include a circular segment extending from an end of the upper shutter furthest from the lower shutter and the chord of the circular segment is a furthest end of the upper shutter.

In another example, the shutter assembly further includes a shutter base coupling the lower shutter to the upper shutter. The lower shutter and the upper shutter can include a radiation shielding material (e.g., lead [Pb]). The shutter assembly further includes a cantilever spring with a first end and a second end. The first end is fixed in position by a middle bracket. The second end applies a resilient force on the upper shutter or a shutter base coupling the lower shutter to the upper shutter. The lower shutter can include a notch in the yoke. The notch in the yoke allows rotation of the lower shutter without applying a direct force on the cantilever spring by the lower shutter.

In another configuration, the shutter assembly further includes a second lower shutter. The second lower shutter includes a second yoke, a second control pin, an inner extension extending from a first end of the second yoke and supports the second control pin, a second inner hinge pin supported by the inner extension of the second yoke and the first shutter bracket, an outer extension extending from a second end of the second yoke, and a second outer hinge pin supported by the outer extension of the second yoke and the second shutter bracket. The second inner hinge pin is hingedly engaged with the inner extension of the second yoke or the first shutter bracket. The second outer hinge pin is hingedly engaged with the outer extension of the second yoke or the second shutter bracket. A length of the yoke is substantially parallel to a length of the second yoke. The shutter control further includes a second ramp feature that is slidably engaged with the second control pin. The second yoke rotates or tilts as the second control pin slides along the second ramp feature. The rotation of the yoke is in an opposite direction as the rotation of the second yoke.

In another example, the shutter assembly further includes a first upper shutter with a lower end that is in communication with the lower shutter, and a second upper shutter with a lower end that is in communication with the second lower shutter. A majority of the first upper shutter has a substantially planar shape. The first upper shutter rotates or tilts with the rotation of the lower shutter and the rotation of the first upper shutter is configured to variably block radiation from passing through an opening (i.e., hole) in the base. A majority of the second upper shutter has a substantially planar shape. The second upper shutter rotates or tilts with a rotation of the second lower shutter, and the rotation of the second upper shutter is configured to variably block radiation from passing through the opening. The slideable movement of the shutter control changes the distance between an upper end of the first upper shutter and an upper end of the second upper shutter.

In another configuration, the lower shutter, the second lower shutter, and the shutter control form a first shutter assembly pair. The collimator assembly further includes a second shutter assembly pair that includes a third lower shutter, a fourth lower shutter, and a second shutter control. The third lower shutter includes a third yoke and a third control pin. The fourth lower shutter that includes a fourth yoke and a fourth control pin. The a second shutter control that includes a third ramp feature that is slidably engaged with the third control pin and a fourth ramp feature that is slidably engaged with the fourth control pin. The second shutter control is slidably engaged with the base. The third yoke rotates or tilts as the third control pin slides along the third ramp feature and the fourth yoke rotates or tilts as the fourth control pin slides along the fourth ramp feature. The rotation of the third yoke is in an opposite direction as the rotation of the fourth yoke. In another example, the length of the lower shutter and the second lower shutter are substantially perpendicular to a length of the third lower shutter and the fourth lower shutter. A length of the shutter control is substantially perpendicular to a length of the second shutter control. The lower shutter, the second lower shutter, the third lower shutter, and the fourth lower shutter form sides of a substantially rectangular shape with overlapping ends. A portion of the lower shutter and the second lower shutter overlap a portion of the third lower shutter and the fourth lower shutter.

In another example, the shutter assembly further includes a control guide attached to the base that substantially confines movement of the shutter control to a single axis. The control guide can include an elongated slot and the shutter control can include at least one protrusion slidably engaged in the elongated slot. The at least one protrusion limits movement of the shutter control in the single axis.

Another example provides a method of collimating radiation. The method includes the operation of sliding a shutter control that includes a ramp feature along a base of a collimator assembly. The next operation of the method can include sliding a control pin along the ramp feature when the shutter control slides along the base. The method can further include rotating or tilting a yoke of a lower shutter about an axis of an inner hinge pin when the control pin slides along the ramp feature. The yoke includes an inner extension extending from a first end of the yoke that supports the control pin and the inner hinge pin. The yoke also includes an outer extension extending from a second end of the yoke that supports an outer hinge pin. The next operation of the method can variably block radiation based on the rotation of the lower shutter.

In a configuration, rotating the yoke of the lower shutter rotates or tilts an upper shutter extending from the lower shutter. The upper shutter includes a radiation shielding material and provides greater variation in blocking radiation than the lower shutter alone.

In another example, the method can further include applying a resilient force from the base to the upper shutter via a cantilever spring. The next operation of the method includes forcing the control pin down onto the ramp feature when the resilient force is applied to the upper shutter.

In another example, a collimator assembly includes a base including an opening (i.e., a hole), two shutter controls, four shutter brackets, and four shutter assemblies. Each shutter assembly is located on one of four sides of the opening and each shutter assembly includes a lower shutter. The lower shutters includes a yoke, a control pin, an inner hinge pin, an inner extension extending from a first end of the yoke and supports the control pin and the inner hinge pin, an outer hinge pin, and an outer extension extending from a second end of the yoke and supports the outer hinge pin. Two opposing shutter assemblies provide a shutter assembly pair, and one shutter assembly pair is substantially perpendicular to another shutter assembly pair. The control pins of the lower shutters of each shutter assembly pair are slidably engaged with separate ramp features of one of the two shutter controls. Each yoke rotates or tilts as the corresponding control pin slides along the corresponding ramp feature. The inner hinge pins of the lower shutters of each shutter assembly pair are supported by an inner shutter bracket that is one of the four shutter brackets. The outer hinge pins of the lower shutters of each shutter assembly pair are supported by an outer shutter bracket that is one of the four shutter brackets. Each inner hinge pin is hingedly engaged with the inner extension or the inner shutter bracket, and each outer hinge pin is hingedly engaged with the outer extension or the outer shutter bracket.

In another configuration, each shutter assembly further includes an upper shutter that is in communication with the lower shutter, wherein the upper shutter rotates or tilts with the rotation of the lower shutter, and the rotation of the upper shutter is configured to variably block radiation from passing through the opening.

The summary provided above is illustrative and is not intended to be in any way limiting. In addition to the examples described above, further aspects, features, and advantages of the invention will be made apparent by reference to the drawings, the following detailed description, and the appended claims.

DETAILED DESCRIPTION OF SOME EXAMPLE EMBODIMENTS

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Numbers provided in flow charts and processes are provided for clarity in illustrating steps and operations and do not necessarily indicate a particular order or sequence. Unless otherwise defined, the term "or" can refer to a choice of alternatives e.g., a disjunction operator, or an exclusive or) or a combination of the alternatives (e.g., a conjunction operator, and/or, a logical or, or a Boolean OR).

Disclosed embodiments relate generally to x-ray collimator and, more particularly, to drive mechanism for shutters of a collimator and methods to operate shutters for a collimator.

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

Figure 1:
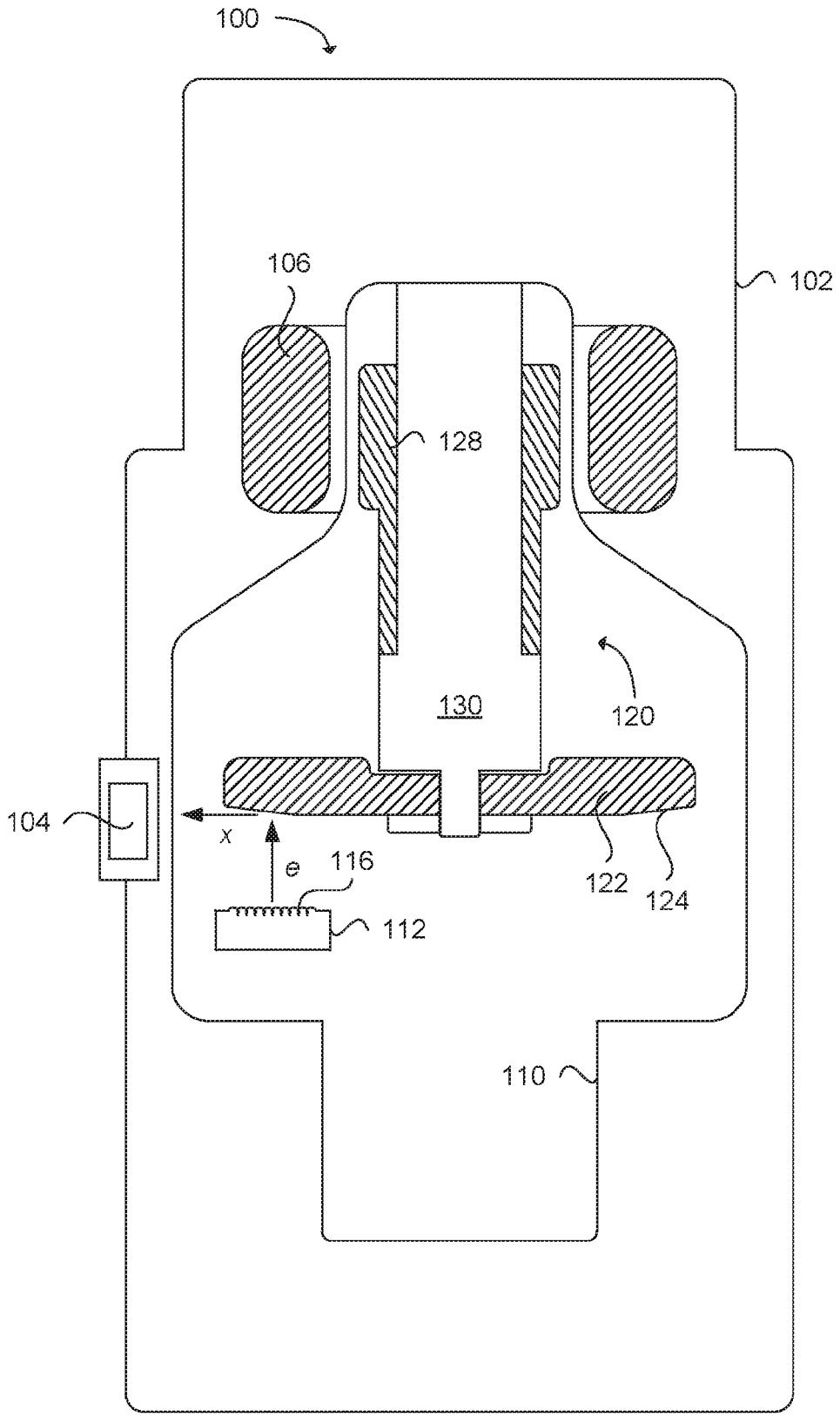
FIG. 1 illustrates a block diagram of an example x-ray tube.

FIG. 1 is a block diagram of an example rotary or rotating anode type x-ray tube 100 with a rotatable disc-shaped anode 122. The x-ray tube 100 includes a housing 102 and an x-ray insert 110 within the housing 102. The housing 102 encloses the insert 110. A coolant or air may fill the space or cavity between the housing 102 and the insert 110. A cathode 112 and an anode assembly 120 are positioned within an evacuated enclosure, also referred to as the insert 110. The anode assembly 120 includes the anode 122, a bearing assembly 130, and a rotor 128 mechanically coupled to the bearing assembly 130. The anode 122 is spaced apart from and oppositely disposed to the cathode 112. The anode 122 and cathode 112 are connected in an electrical circuit that allows for the application of a high voltage potential between the anode 122 and the cathode 112. The cathode 112 includes an electron emitter 116 that is connected to an appropriate power source (not shown).

As disclosed in FIG. 1, prior to operation of the example x-ray tube 100, the insert 110 is evacuated to create a vacuum. The insert 110 encloses the vacuum. Then, during operation of the example x-ray tube 100, an electrical current is passed through the electron emitter 116 of the cathode 112 to cause electrons "e" to be emitted from the cathode 112 by thermionic emission. The application of a high voltage differential between the anode 122 and the cathode 112 then causes the electrons "e" to accelerate from the cathode electron emitter toward a focal spot on a focal track 124 that is positioned on the anode 122. The focal track 124 may be composed for example of tungsten (W) and rhenium (Re) or other materials having a high atomic ("high Z") number. As the electrons "e" accelerate, they gain a substantial amount of kinetic energy, and upon striking the rotating focal track 124 some of this kinetic energy is converted into x-rays "x".

The focal track 124 is oriented so that emitted x-rays "x" are visible to an x-ray tube window 104. The x-ray tube window 104 includes an x-ray transmissive material, such as beryllium (Be), so the x-ray's "x" emitted from the focal track 124 pass through the x-ray tube window 104 in order to strike an intended object (not shown) and then the detector to produce an x-ray image (not shown). FIG. 1 illustrates a single window 104 on the housing 102 (e.g., with a glass insert that allows radiation to pass through the glass of the insert). In other examples, a separate window may be included on both the insert 110 (e.g., a metal insert) and the housing 102, or a window may be included on just the insert 110.

As the electrons "e" strike the focal track 124, a significant amount of the kinetic energy of the electrons "e" is transferred to the focal track 124 as heat. To reduce the heat at a specific focal spot on the focal track 124, a disc-shaped anode target is rotated at high speeds, typically using an induction motor that includes a rotor 128 and a stator 106. The induction motor is an alternating current (AC) electric motor in which the electric current in the rotor 128 needed to produce torque is obtained by electromagnetic induction from a magnetic field of stator winding. Then, the rotor 128 rotates a hub of the bearing assembly 130 that is mechanically coupled to the anode 122, which rotates the anode 122. In other examples (not shown), the x-ray tube uses a stationary' track.

After the x-rays are emitted from the x-ray tube, the x-rays strike an intended object (e.g., the patent or inanimate object) and then the radiation detector to produce an x-ray image. The radiation detector includes a matrix or array of pixel detector elements. The pixel detector elements (e.g., x-ray detector element or detector element) refer to an element in a matrix or array that converts x-ray photons to electrical charges. A detector element may include a photoconductor material which can convert x-ray photons directly to electrical charges (electron-hole pairs) in a direct detection scheme. Suitable photoconductor material include and are not limited to mercuric iodide ($HgI_2$), lead iodide ($PbI_2$), bismuth iodide ($BiI_3$), cadmium zinc telluride (CdZnTe), or amorphous selenium (a-Se). In some embodiments, a detector element may comprise a scintillator material which converts x-ray photons to light and a photosensitive element coupled to the scintillator material to convert the light to electrical charges (i.e., indirect detection scheme). Suitable scintillator materials include and are not limited to gadolinium oxisulfide ($Gd_2O_2S$:Tb), cadmium tungstate ($CdWO_4$), bismuth germinate ($Bi_4Ge_3O_{12}$ or BGO), cesium iodide (CsI), or cesium iodide thallium (CsI:Tl)). Suitable photosensitive element may include a photodiode, a photogate, or phototransistors. Other circuitry for pixel detector elements may also be used.

Figure 2:
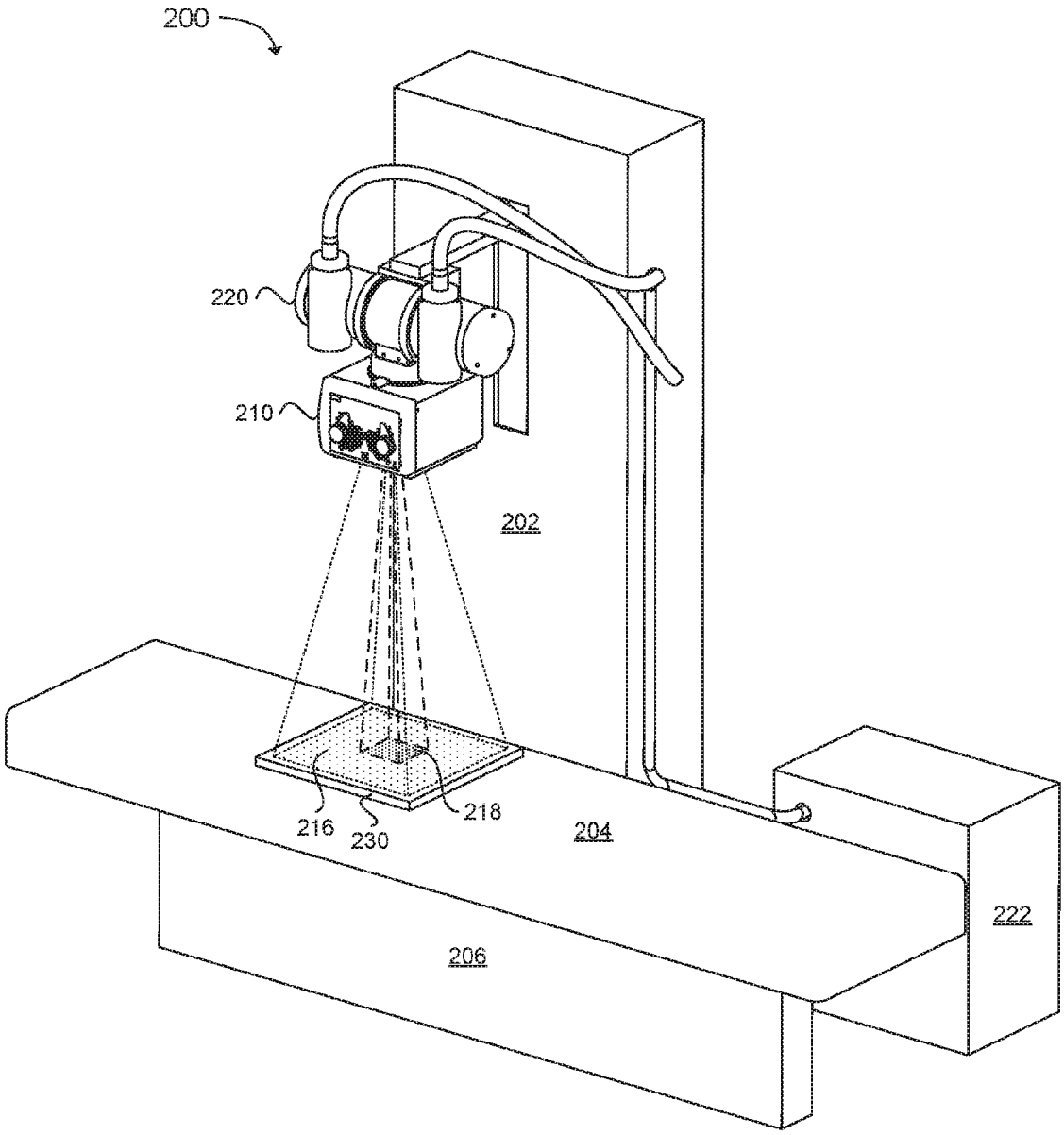
FIG. 2 illustrates a perspective view of an example x-ray system that includes a collimator.

The x-ray tube and radiation detector can be components in an imaging system that are located in an x-ray room. FIG. 2 illustrates an imaging or x-ray system 200 that includes an x-ray-tube 220, a tube generator 222 to provide power and signals to the x-ray tube, a collimator 210 to shape the x-ray beam from the x-ray tube, an x-ray tube support 202 to support the x-ray tube and collimator, a radiation or x-ray detector 230 to capture the emitted x-ray, a table 204 to support a patient or object, and a table pedestal 206 to support the table. The x-ray tube or x-ray tube support can include a mechanism to rotate the x-ray tube in both the horizontal and axial direction relative to the x-ray tube support. The collimator can be coupled near the x-ray tube window 104 (FIG. 1). In a fully open position, the collimator can allow a maximum field size 216 of the x-ray beam, which area or size can change based on the distance of the x-ray detector from the x-ray tube. The maximum field size is the largest effective area that radiation can strike for an x-ray tube-collimator combination. Effective area is the area with radiation strong enough that the radiation can be detected by pixel detector elements of an x-ray detector. As illustrated, the maximum field size is smaller than the area of the x-ray detector. In other examples, the maximum field size of the collimator is larger, equal to, or smaller than the x-ray detector. The operation of the collimator can reduce the effective area of the x-ray radiation down to a minimum collimated field size 218. The minimum collimated field size is the effective area of the x-ray radiation with the collimator in a fully closed position. With adjustment to the collimator, the x-ray radiation can have various sizes or shapes (e.g., rectangles) between the maximum field size and the minimum collimated field size. Although the collimator is shown with an x-ray tube, the collimator 210 may also be used with another radiation source.

Figure 3:
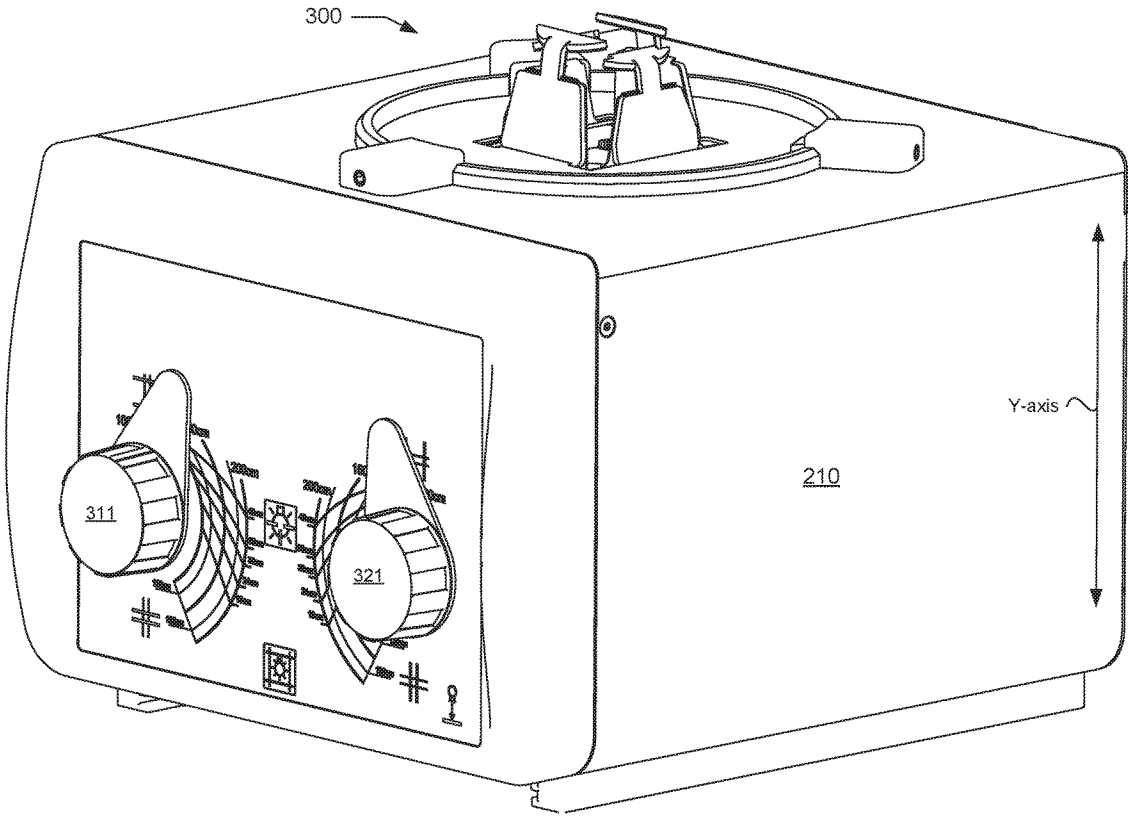
FIG. 3 illustrates a perspective view of an example collimator.

FIG. 3 illustrates a perspective view of the collimator 210 shown in FIG. 2. The collimator 210 include a collimator assembly 300 (i.e., a first collimator assembly) and dials 311 and 321 to adjust shutters of the collimator assembly. The cross control dial 311 adjust the shutters in the cross shutter control assembly 310 (FIGS. 8A-9B), which adjusts the x-ray radiation exposure in a front to back direction, if viewed from the control dials. The long control dial 321 adjust the shutters in the long shutter control assembly 320 (FIGS. 10A-11B), which adjusts the x-ray radiation exposure in a side to side direction, if viewed from the control dials. The collimator may include a light or laser (not shown) that is illuminated through the collimator window 208 (FIG. 14) to help position the x-ray tube and collimator relative to the object, patient, or x-ray detector 230 (FIG. 2). In another example (not shown), the laser may use a different opening from the collimator window. A mirror may be used to center the collimator light with the collimator assembly. The collimator can include components that include metals (e.g., stainless steel or lead), polymers (e.g., plastics and rubber), paints, or other rigid or resilient materials. The collimator assembly 300 provides one set of shutters for the collimator 210. In another example, the collimator may include another set of shutters (i.e., cross shutters 240 and long shutters 242 in a second collimator assembly in FIG. 15) located within a housing of the collimator. The shutters 240 and 242 of the second collimator assembly can include a radiation shielding or absorbing material and provide additional collimating functionality. The dials 311 and 321 can adjust shutters of the first collimator assembly 300 along with the shutters 240 and 242 of the second collimator assembly.

Figure 4:
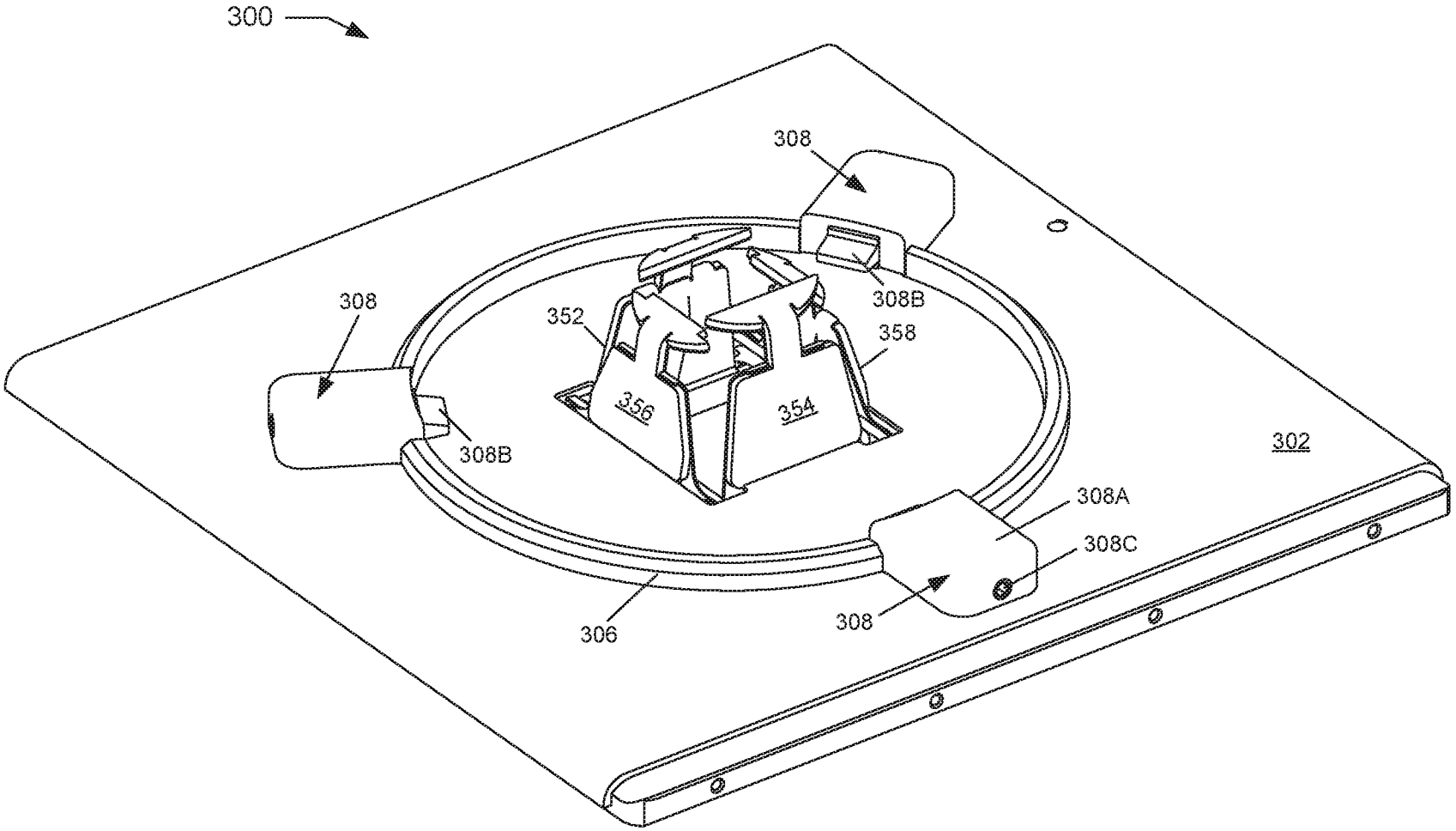
FIG. 4 illustrates a perspective top view of an example collimator assembly.

FIGS. 4-13B illustrate various views of the collimator assembly 300. FIG. 4 shows a perspective top view of the collimator assembly. The collimator assembly 300 can include a base 302 (collimator base) with an opening, a source alignment flange 306 that can be used to couple the collimator to the x-ray tube (or tube assembly), and shutters to variably block electromagnetic waves (e.g., light and x-ray radiation) passing through the opening. The source alignment flange 306 is shown as a protrusion and a ring. In other examples, the source alignment flange can have another shape that can mate or couple to the x-ray tube. The source alignment flange includes flange lock assemblies 308 that include a flange lock housing 308A, a flange lock 308B, and a set screw 308G. The flange lock 308B adjustably applies a force on a mating feature of the x-ray tube. The adjustment is provided by a set screw 308G. The set screw head can be a hexagonal, slot, Phillips, Torx head, or other type of head that allows a torque to be applied to the screw.

Figure 5:
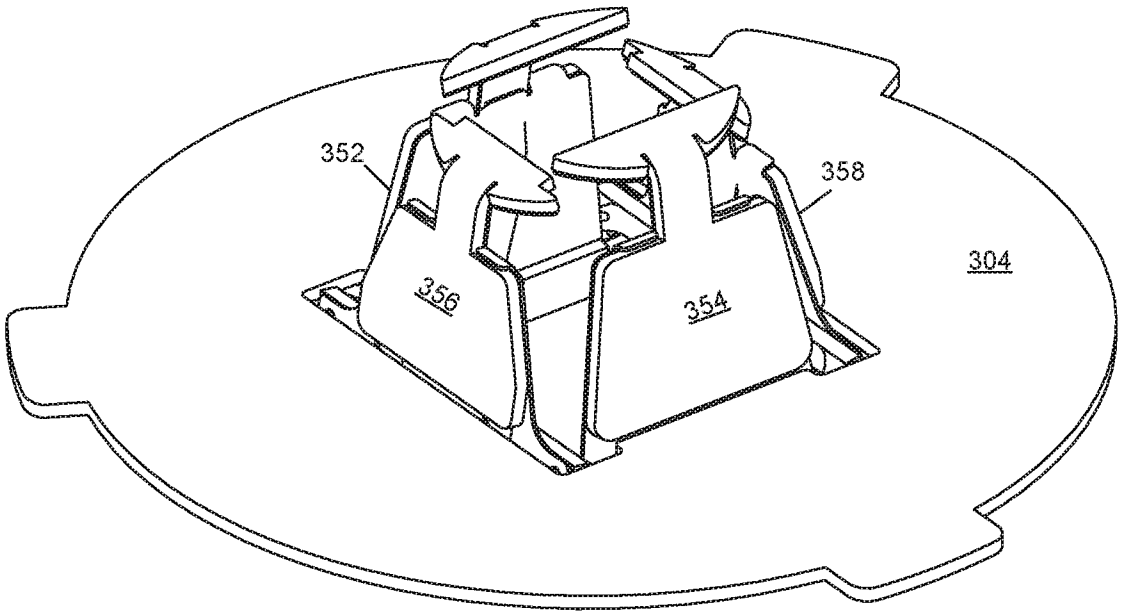
FIG. 5 illustrates a perspective top view of an example collimator assembly on a base radiation shield.

The collimator assembly 300 can include four shutter assemblies for the four sides of the opening. Each shutter assembly can include an upper shutter 352, 354, 356, and 358; a lower shutter 332, 334, 336, and 338; and a shutter base 342, 344, 346, and 348 that couples the lower shutter to the upper shutter. Upper refers to a relative position closer to (e.g., in the y-axis) an x-ray source or x-ray tube. Lower refers to a relative position further away from (e.g., in the y-axis) the x-ray source or x-ray tube. The shutter base can have a substantially planar form that follows the form of the upper shutter or lower shutter. Upper and lower can refer to relative positions along a y-axis. The upper shutter can be coupled to one side of the shutter base and the lower shutter can be coupled to another side of the shutter base. The coupling may include screws. In another example (not shown), the upper shutter and lower shutter can be coupled to the same side of the shutter base. FIGS. 4-13B illustrate the upper shutter, lower shutter, and shutter base as three separate components. In another example, the upper shutter, lower shutter, and shutter base may be integrated as one or two components. The upper shutter, lower shutter, or shutter base can include a radiation shielding or absorbing material, such as lead (Pb). As illustrated in FIG. 5, the base (302 of FIG. 4) of the collimator assembly can include a base radiation shield 304 that includes radiation shielding or absorbing material, such as lead (Pb). Thus, the radiation emitted from the x-ray tube can be blocked by the radiation shielding or absorbing material except through the opening of the base and the area not blocked by shutters of the shutter assemblies.

Figure 6:
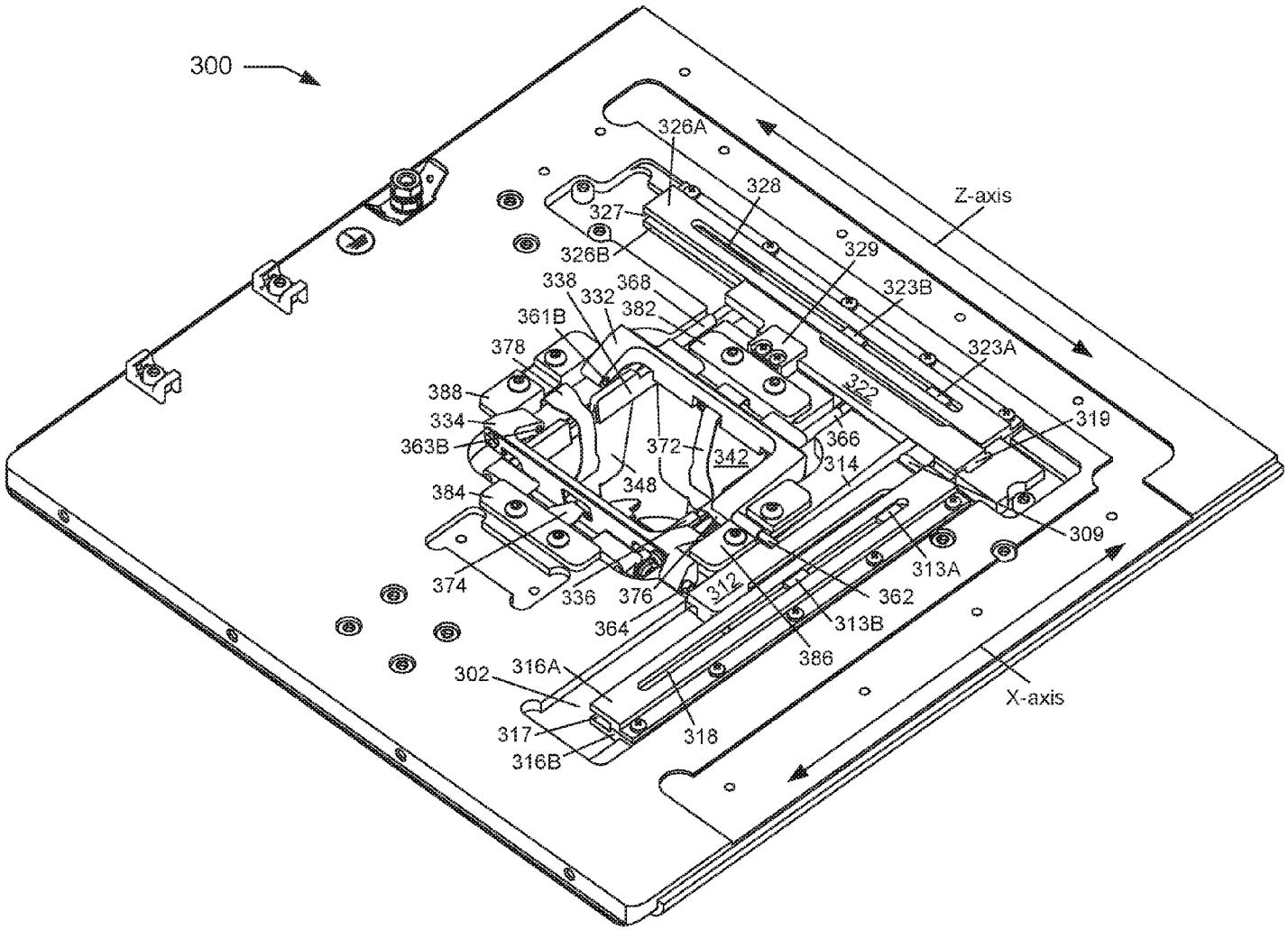
FIG. 6 illustrates a perspective bottom view of an example collimator assembly.

FIG. 6 illustrates a perspective bottom view of the collimator assembly 300. The collimator assembly includes two sets of shutters: cross shutters 332, 334, 342, 344, 352, and 354 controlled by a cross shutter control 312 that is moved, driven, or adjusted (e.g., in the x-axis) by the cross control dial 311 (FIG. 3) for front and back adjustment; and long shutters 336, 338, 346, 348, 356, and 358 controlled by a long shutter control 322 that is moved, driven, or adjusted (e.g., in the y-axis) by the long control dial 321 (FIG. 3) for side to side adjustment. In another example (not shown), the cross shutter control and the long shutter control is operated by a motorized mechanism and electronic controls (with or without feedback and sensors).

Referring back to FIG. 6, the cross shutter control 312 operates on the cross shutters via the cross lower shutters 332 and 334. The long shutter control 322 operates on the long shutters via the long lower shutters 336 and 338. Cross refers to components associated with or near the cross shutter control 312. Long refers to components associated with or near the long shutter control 322. Each lower shutter includes an inner extension 332A, 334A, 336A, and 338A; an outer extension 332C, 334C, 336C, and 338C; and a yoke 334B, 336B, and 338B that couples the inner extension to the outer extension. Inner refers to a relative position of a component closer to a shutter control (e.g., cross shutter control 312 and long shutter control 322). Outer refers to a relative position of a component farther away from the shutter control. For example, a cross inner lower shutter (CILS) 332 is closer to the long shutter control 322 than a cross outer lower shutter (COLS) 334. A long inner lower shutter (LILS) 336 is closer to the cross shutter control 312 than a long outer lower shutter (LOLS) 338. Similarly, the COLS inner extension 334A is closer to the cross shutter control 312 than the COLS outer extension 334C. From a top or bottom view, the ends (e.g., yoke or extension) of the lower shutter can overlap with the ends of an adjacent lower shutter. For example, the ends of CILS 332 overlaps with ends of LILS 336 and LOLS 338, and the ends of COLS 334 overlaps with the other ends of LILS 336 and LOLS 338.

Figure 7:
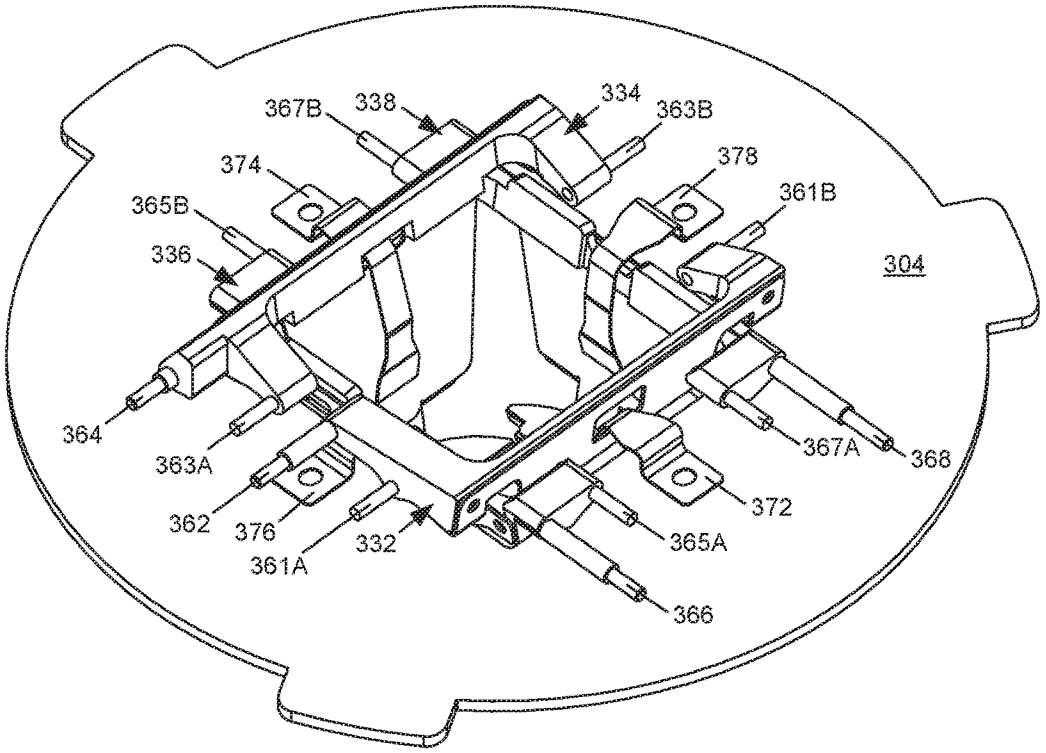
FIG. 7 illustrates a perspective bottom view of an example collimator assembly on a base radiation shield.
Figure 8A:
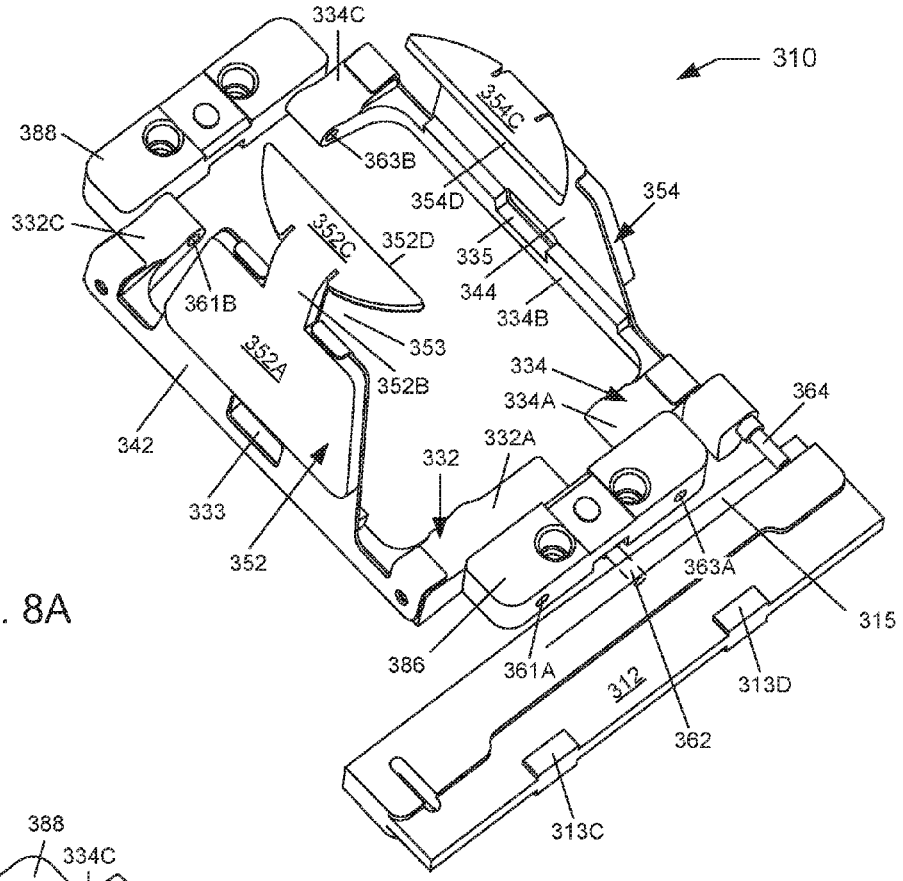
FIG. 8A illustrates a perspective top view of cross shutters and control assembly in an open position.
Figure 8B:
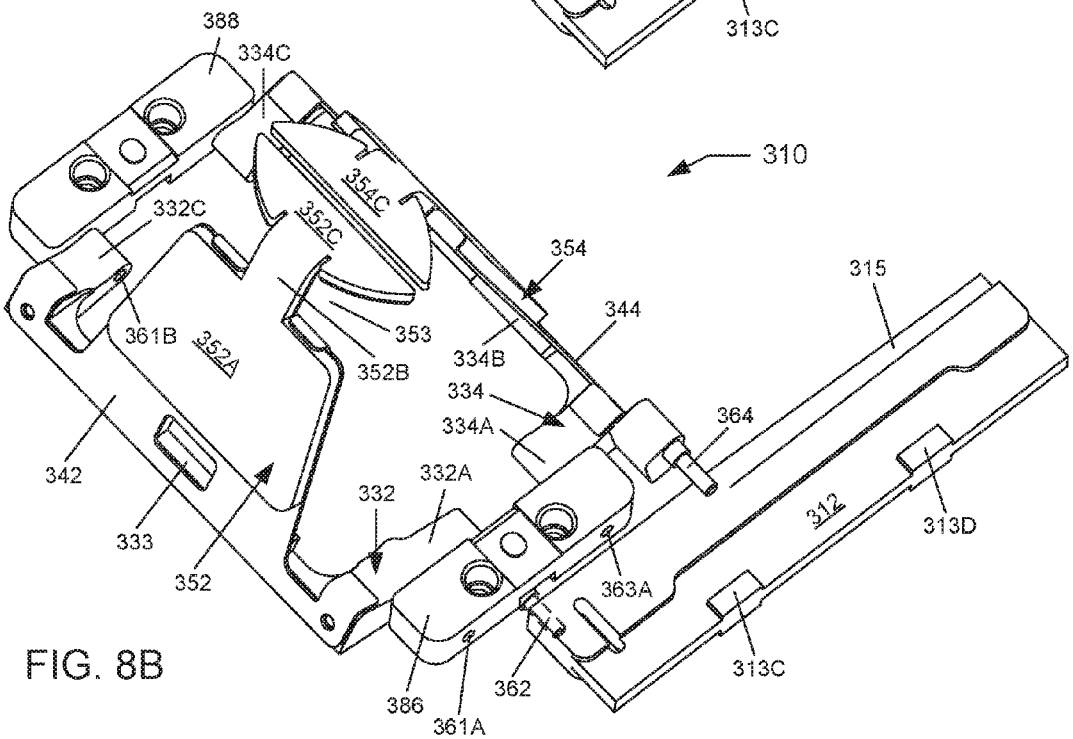
FIG. 8B illustrates a perspective top view of cross shutters and control assembly in a closed position.
Figure 9A:
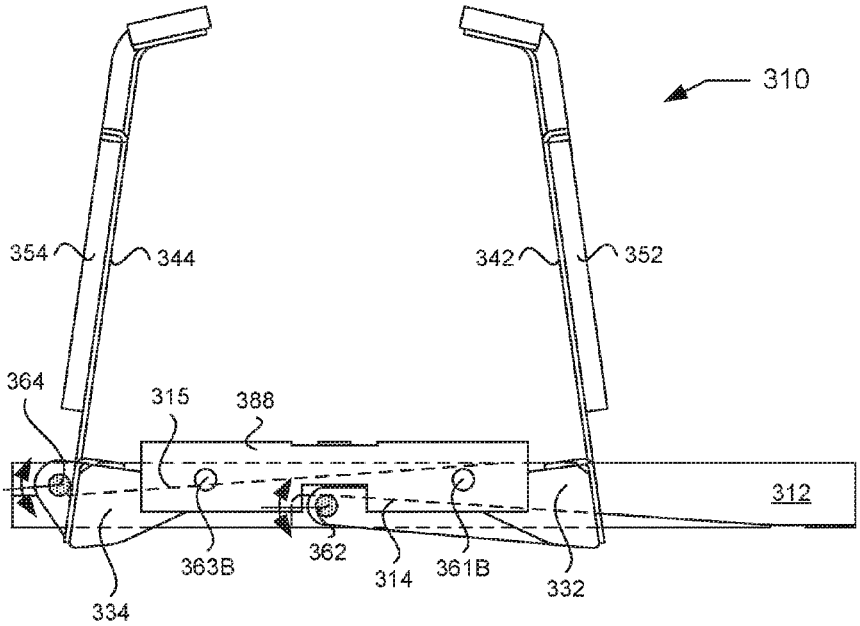
FIG. 9A illustrates a side view of cross shutters and control assembly in an open position.
Figure 9B:
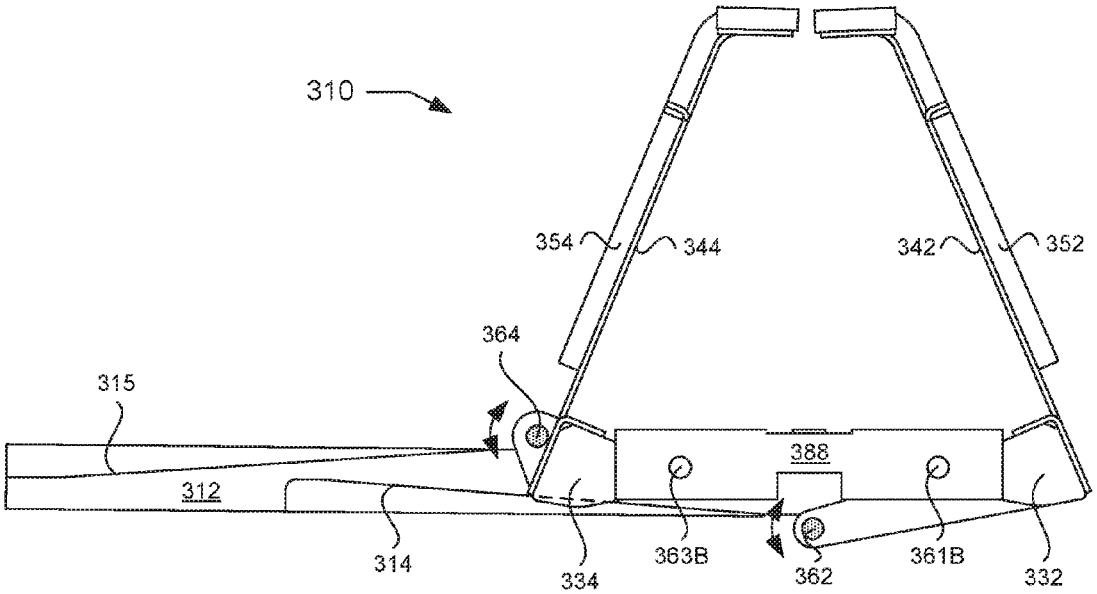
FIG. 9B illustrates a side view of cross shutters and control assembly in a closed position.
Figure 10A:
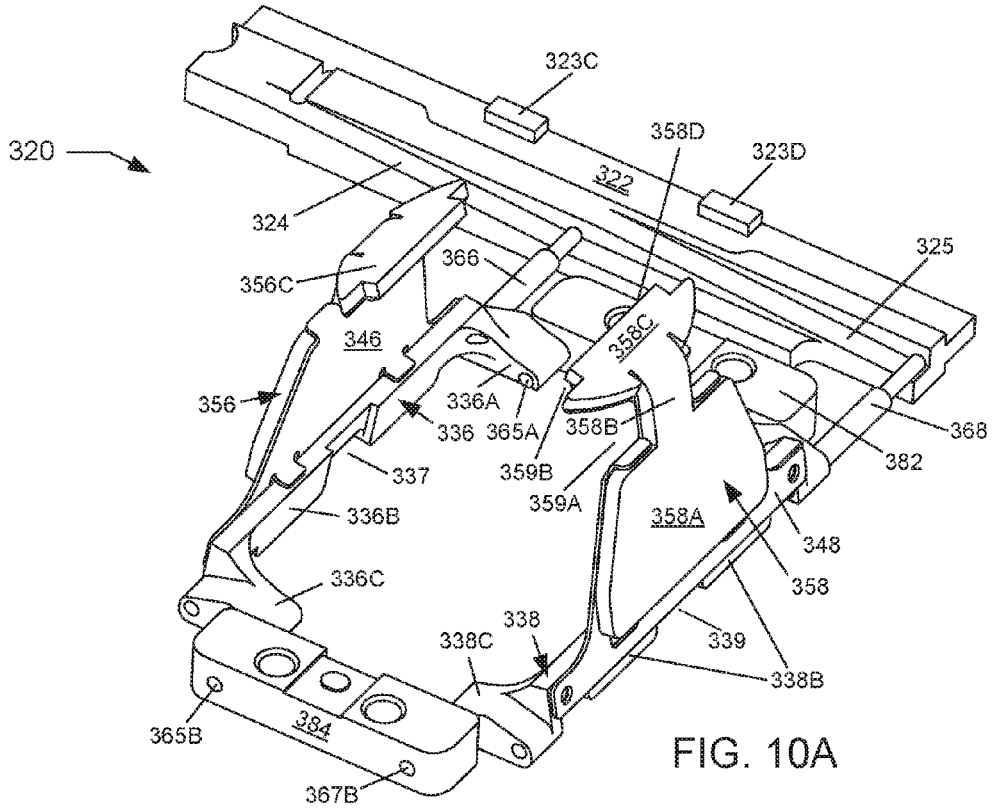
FIG. 10A illustrates a perspective top view of long shutters and control assembly in an open position.
Figure 10B:
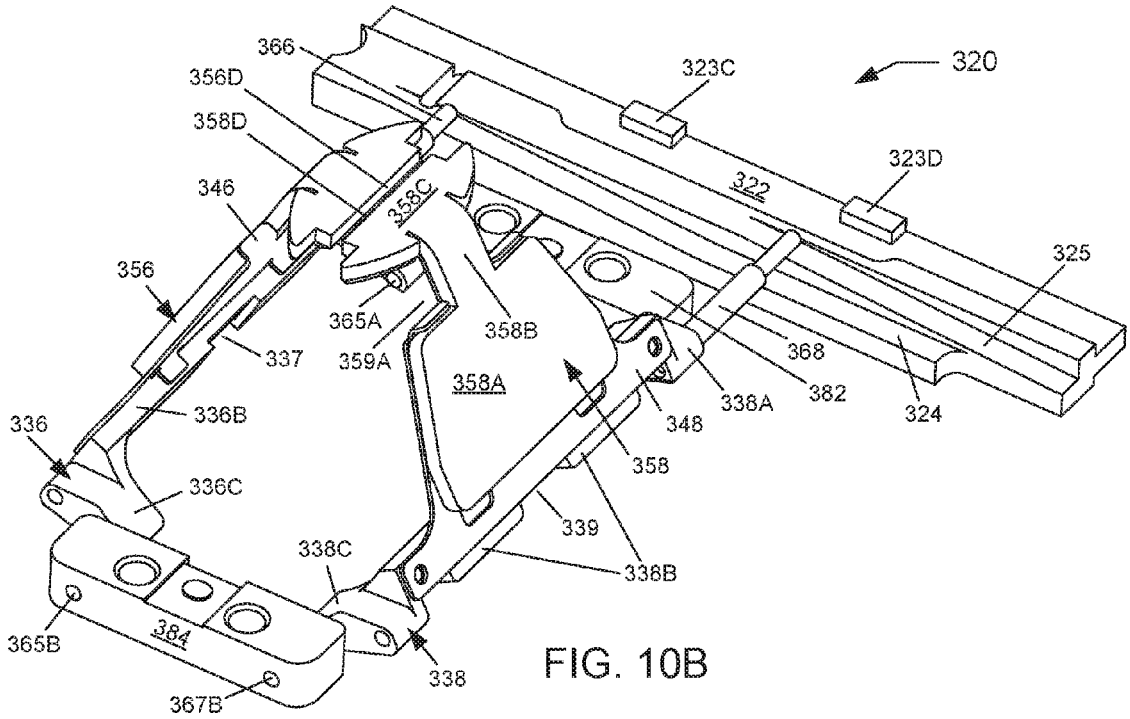
FIG. 10B illustrates a perspective top view of long shutters and control assembly in a closed position.
Figure 11A:
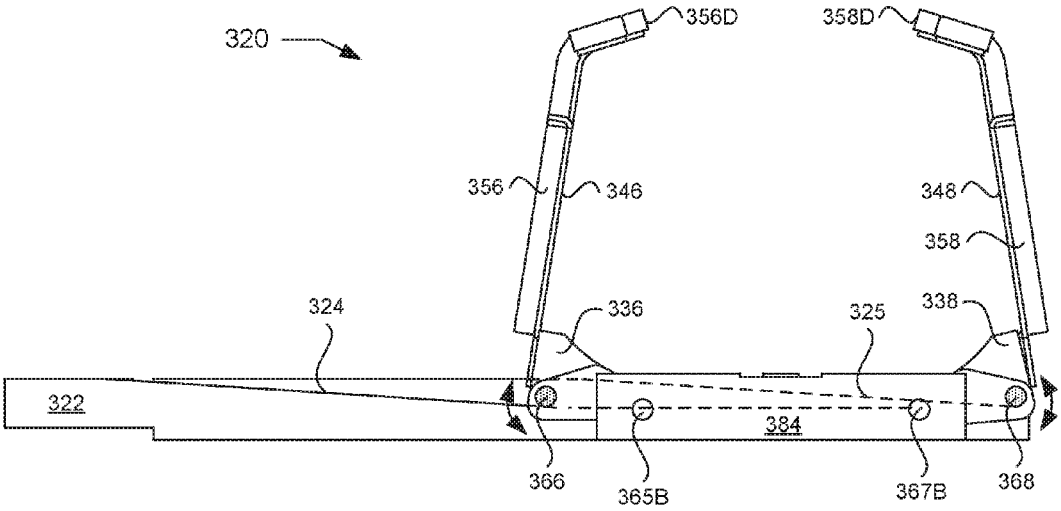
FIG. 11A illustrates a side view of long shutters and control assembly in an open position.
Figure 11B:
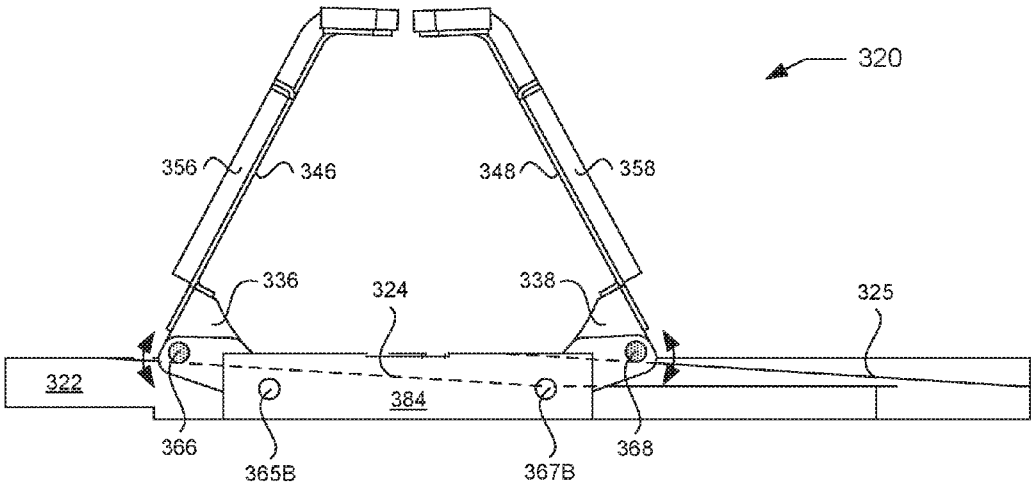
FIG. 11B illustrates a side view of long shutters and control assembly in a closed position.

The extensions of the lower shutters support control pins and hinge pins, which is also illustrated in FIG. 7. The inner extension 332A, 334A, 336A, and 338A supports a control pin 362, 364, 366, and 368 and an inner hinge pin 361A, 363A, 365A, and 367A. The outer extension 332C, 334C, 336C, and 338C supports an outer hinge pin 361B, 363B, 365B, and 367B. The lower shutters are hingedly engaged or connected to the base 302 through the hinge pins supported by brackets 382, 384, 386, and 388. For example, the CILS inner hinge pin 361A and the COLS inner hinge pin 363A are supported by the LILS bracket 386, and the CILS outer hinge pin 361B and the COLS outer hinge pin 363B are supported by the LOLS bracket 388. The LILS inner hinge pin 365A and the LOLS inner hinge pin 367A are supported by the CILS bracket 382, and the LILS outer hinge pin 365B and the LOLS outer hinge pin 367B are supported by the COLS bracket 384. The brackets are coupled to the base using screws, bolts, semi-permanent attachment mechanism, or permanent attachment mechanism. A semi-permanent attachment mechanism includes a screw, a bolt, or other mechanism that can be attached or unattached through manipulation of a component of the attachment mechanism. A permanent attachment includes a weld, an adhesive, heat or chemical treatment to combine two component together, which requires more than manipulation of the components to remove the components from each other without damage to the components. Unless otherwise stated, the attachments for the collimator assembly can be provide by the semi-permanent attachment mechanism or the permanent attachment. The bracket 386 and 388 may include a notch (e.g., LILS bracket notch 387 or LOLS bracket notch 389). For example, the LILS bracket 386 includes a LILS bracket notch 387 to allow downward movement of the CILS control pin 362 on a cross control inner ramp 314 (also seen in FIG. 9B).

The lower shutters 332, 334, 336, and 338 (e.g., the yoke 334B, 336B, and 338B) rotate or pivot around or about the hinge pins 361A-B, 363A-B, 365A-B, and 367A-B with the inner extensions 332A, 334A, 336A, and 338A along with the control pins 362, 364, 366, and 368 acting as a lever arms. The control pin moves in a nearly vertical (e.g., up and down with a slight angle) based on lateral movement (along the x-axis or the z-axis) of the shutter control 312 and 322 along the base 302. The shutter control can have a substantially rectangular cuboid with various features. Each shutter control 312 and 322 includes at least one ramp feature 314, 315, 324, and 325 (i.e., incline/decline portion or wedge in the shutter control) that is slidably engaged with the control pins. The cross shutter control 312 includes two ramp features (i.e., cross control inner ramp 314 and cross control outer ramp 315) on opposite sides of the shutter control. The cross control inner ramp 314 slidably engages with CILS control pin 362, and the cross control outer ramp 315 slidably engages with COLS control pin 364. The long shutter control 322 includes two ramp features (i.e., long control inner ramp 324 and long control outer ramp 325) on a same side of the shutter control. The long control inner ramp 324 slidably engages with LILS control pin 366, and the long control outer ramp 325 slidably engages with LOLS control pin 368. As the shutter control slides along a single axis (e.g., x-axis or the z-axis), the control pin slides along the ramp and moves the control pin up or down (in the y-axis) a ramp, which in turn rotates or pivots the lower shutter. The lower shutter then rotates or tilts the shutter base 342, 344, 346, and 348 and the upper shutter 352, 354, 356, and 358, which moves opposing upper shutters closer together or farther apart to collimate the radiation (or electromagnetic wave). A large movement of the control pin along the ramp can generate a relatively small rotation of the lower shutter, which can provide a relative small movement of a circular flange segment 352C, 354C, 356C, and 358C of the upper shutter. The slope (or angle) of the ramp can determine the amount (or degree) of rotation or tilt of the lower shutter relative to the linear motion of the shutter control. A length of the lever arm of the inner extension of the lower shutter can also determine the amount (or degree) of rotation or tilt of the lower shutter relative to the linear motion of the shutter control. For example, a steep slope increases the rotation or tilt of the lower shutter with a linear motion to the shutter control compared to a shallow slope. The slope of multiple ramps can be similar to each or differ from each other. For example, the cross shutter control can have ramp slopes that are similar and the long shutter control can have ramp slopes that are similar, but the ramp slopes of the cross shutter control can have different angles from the ramp slopes of the long shutter control.

The control pins 362, 364, 366, and 368 can have a cylindrical shape with various diameters in the same control pin. The different diameter can be used various reasons, such as avoiding contact with other components. For example, the LOLS control pin 368 can have a narrow diameter near the long control ramps 324 and 325 to avoid contact with the long control inner ramp 324.

As illustrated by FIG. 7, a flat spring or cantilever spring 372, 374, 376, and 378 applies a resilient force on the shutter base 342, 344, 346, and 348 (or upper shutter). A resilient force is a force provided by a resilient or elastic component, such as a spring, which changes as the resilient or elastic component deflects. In an example, the shutter base may allow some deflection of the shutter. One end of the spring can be held or fixed in position by the bracket 382, 384, 386, and 388. The 372 CILS spring is secured by the CILS bracket 382, the COLS spring 374 is secured by the COLS bracket 384, the LILS spring 376 is secured by the LILS bracket 386, and the LOLS spring 378 is secured by the LILS bracket 386. The other end of the spring slides along the shutter base. The resilient force of the spring is translated as a force on the control pin 362, 364, 366, and 368 onto the ramp feature 314, 315, 324, and 325, which can keep the control pin engaged on the ramp features. The yoke 334B, 336B, and 338B of the lower shutter 332, 334, 336, and 338 can include a lower shutter notch 333, 335, 337, and 339 above the lower shutter, as with CILS notch 333 and COLS notch 335, or below or laterally to the lower shutter, as with LILS notch 337 and LOLS notch 339 to allow free movement of the spring without interference from the lower shutter or having the spring touch the lower shutter. The shutter base (e.g., cross inner shutter base [CISB] 342 and cross outer shutter base [COSB] 344) may include a slot or opening for the spring to cross the plane of shutter base from the bracket to an opposite side of the shutter base.

Referring back to FIG. 6, each shutter control 312 and 322 is slidably engaged with a control guide or control guide assembly 316 and 326 that is attached (e.g., using screws) to the base 302. In an example, the control guide components or structure 316 and 326 can have similar features. The control guide includes a guide channel (e.g., cross guide channel 317 or long guide channel 327) in the control guide that supports a portion of the shutter control. The guide channel can be a void (i.e., space) in the control guide. The control guide assembly can include a single component or multiple components. FIG. 6 illustrates the control guide assembly as two components that are mirror images of each other (e.g., lower cross control guide 316A and upper cross control guide 316B for the cross shutter control assembly 310; and lower long control guide 326A and upper long control guide 326B for the long shutter control assembly 320). The control guide includes a guide slot (e.g., lower cross guide slot 318 and upper cross guide slot [not shown]; and lower long guide slot 328 and upper long guide slot [not shown]) that slidably engages with control protrusions (e.g., cross control protrusions 313A-D and long control protrusions 323A-D) extending from the shutter control. The control protrusions can extend above a substantial surface or plane of the shutter control and below a substantial surface or plane of the control guide. The guide channel and the control protrusions substantially confine, restrict, or limit the movement of the shutter control to a single axis (e.g., x-axis for the cross shutter control 312 and z-axis for the long shutter control 322). The cross shutter control slides along the cross control guide 316 in the x-axis. The long shutter control slides along the long control guide 326 in the z-axis. The length of the guide slot and the position of the control protrusions can confine, restrict, or limit the distance or movement of the shutter control within the single axis. The control guide and guide channel interfaces with one edge of the shutter control (opposite to the edge or side with the ramp features), which can reduce tilting, lifting, twisting, or torque of the shutter control.

Another guide on the opposite edge of the shutter control (on the same edge or side with the ramp features), such as a long anti-tilting block or bracket 329, can provide additional stability against tilting, lifting, twisting, or torque of the shutter control. The long anti-tilting block 329 can hold the long shutter control 322 in a substantially parallel position relative to the base or control guide when the LILS control pin 366 and LOLS control pin 368 apply a force on the long control ramps 324 and 325.

The cross shutter control 312 may also include a cross shutter control notch 309 that can receive a cross collimator guide 212 (FIG. 14) that couples the cross shutter control to the cross control dial 311 via a geared mechanism. The long shutter control 322 may also include a long shutter control notch 319 that can receive a long collimator guide 214 (FIG. 14) that couples the long shutter control to the long control dial 321 via another geared mechanism.

Figure 12A:
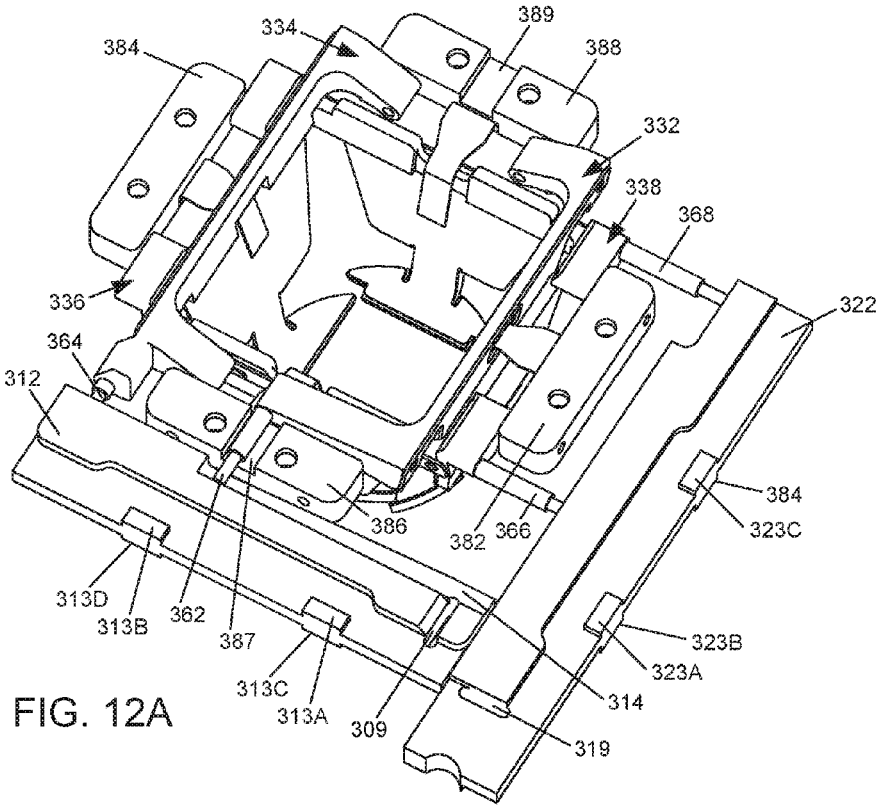
FIG. 12A illustrates a perspective bottom view of an example collimator assembly in an open position.
Figure 12B:
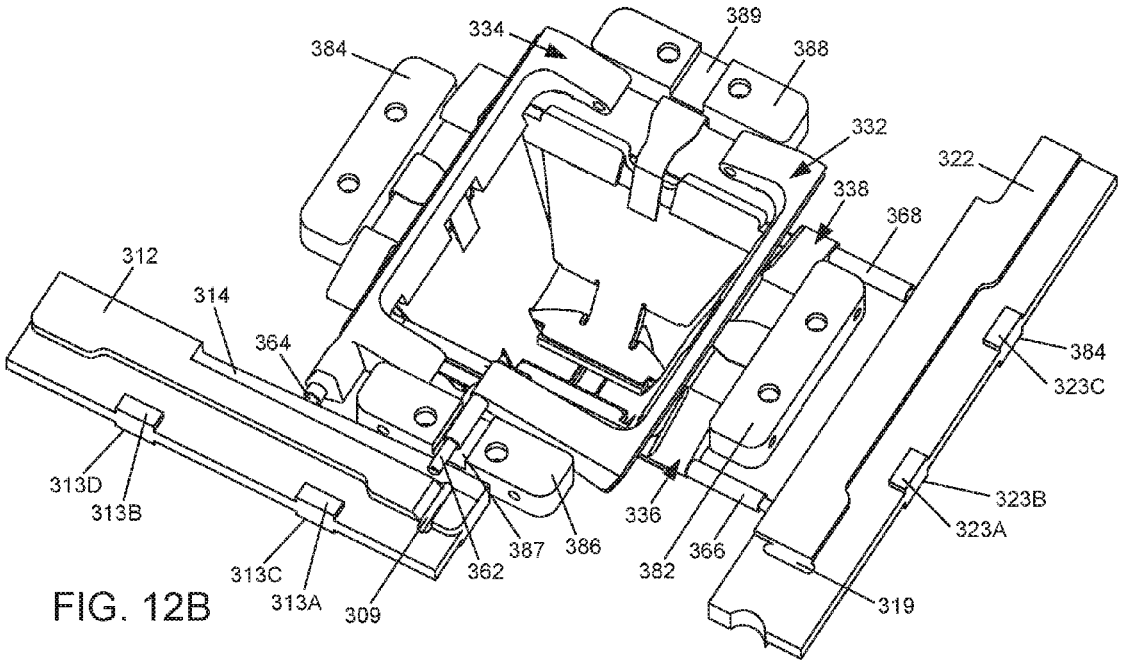
FIG. 12B illustrates a perspective bottom view of an example collimator assembly in a closed position.
Figure 13A:
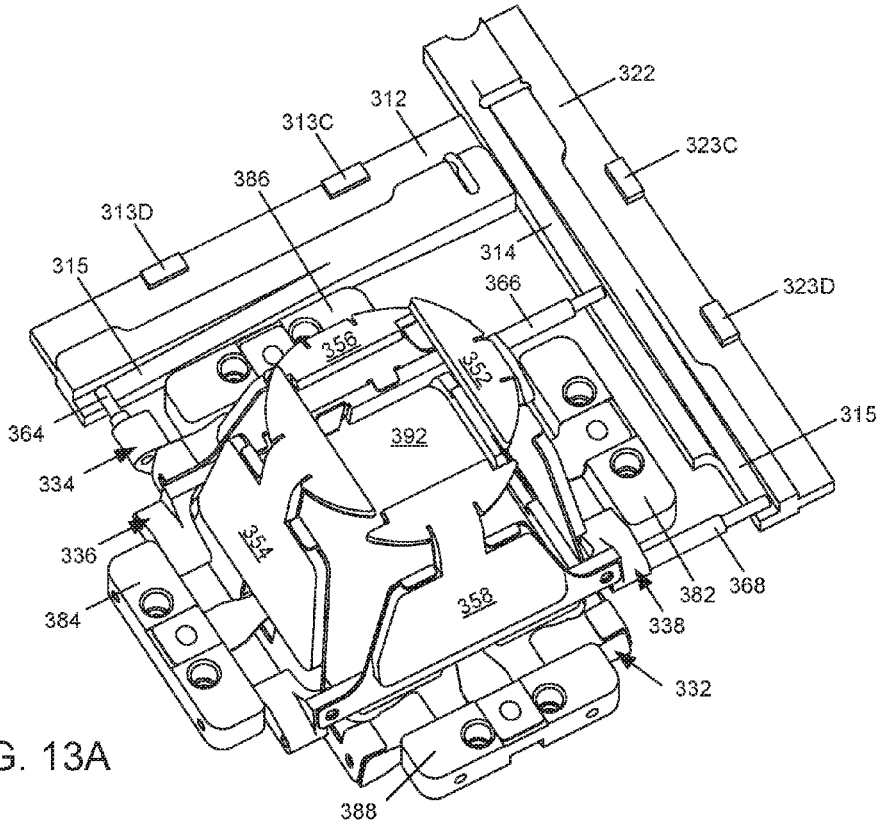
FIG. 13A illustrates a perspective top view of an example collimator assembly in an open position.
Figure 13B:
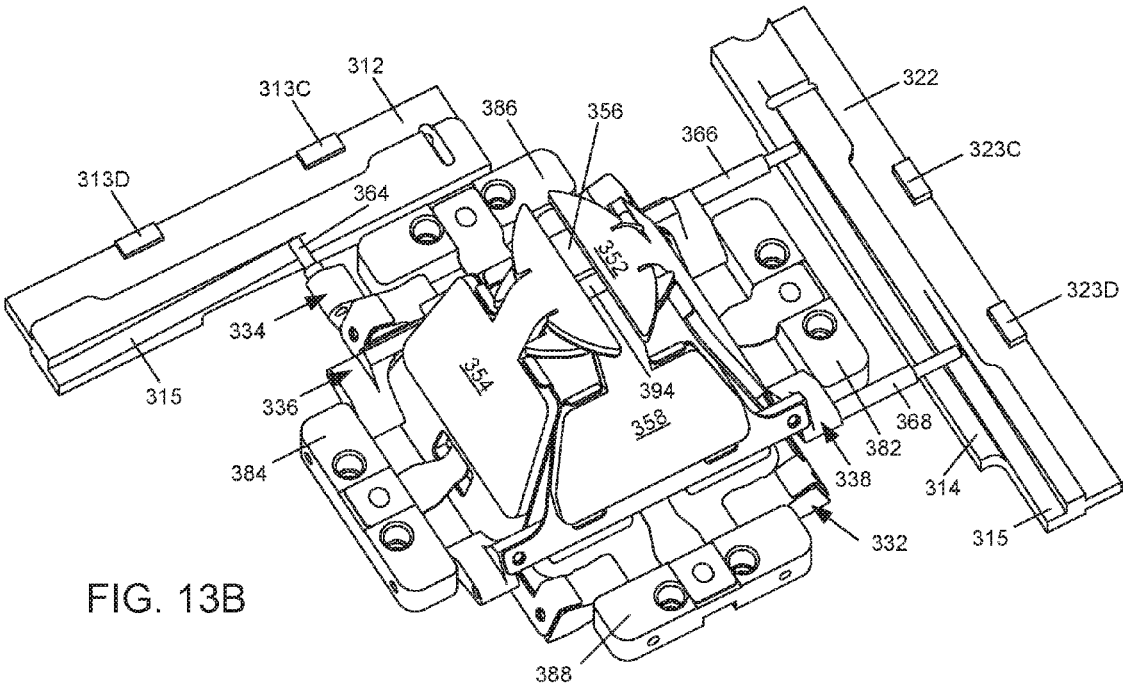
FIG. 13B illustrates a perspective top view of an example collimator assembly in a closed position.

FIGS. 8A-9B illustrate various views of cross shutters (including a cross inner upper shutter [CIUS] 352 and a cross outer upper shutter [COUS] 354) relative to the cross shutter control 312 in open and closed positions. FIGS. 10A-11B illustrate various views of long shutters (including a long inner upper shutter [LIUS] 356 and a long outer upper shutter [LOUS] 358) and the long shutter control 322 in open and closed positions. FIGS. 12A-B illustrate perspective bottom views of the collimator assembly in open and closed positions. FIGS. 13A-B illustrate perspective top views of the collimator assembly in open and closed positions. As shown in FIGS. 8A-8B and 10A-10B, the upper shutter can have substantially folded planar shape (or folded plate) of an "I" with one elongated flange (or substantially planar flange segment 352A, 354A, 356A, and 358A) and another circular segment flange (or circular flange segment 3520, 354C, 356C, and 358C) with a web 352B and 358B joining the elongate flange with the circular segment flange. A void between the planar flange segment and the circular flange segment can be referred to as the web notch 353 and 359A. The web and web notch can facilitate overlapping circular segment flanges in adjacent shutters (upper shutters and shutter base) when the shutters are in a closed position. For example, the LIUS circular flange segment 586C and the LOUS circular flange segment 358C can be on the same plane in the vertical (y-axis) as the CIUS web 352B. CIUS web notch 353, COUS web, and COUS web notch, as shown in FIG. 13B. The circular flange segment may also include a circular segment notch 359B to accommodate the web of an adjacent shutter in a closed position. For example, the LOUS circular segment notch 359A and LIUS circular segment notch can be notched (e.g., substantially rectangular cuboid void) to accommodate the CIUS web 352B and COUS web in a closed position, as shown in FIG. 13B. The planar surface of the circular flange segment can be at angle between 60° and 120° angle with the planar flange segment, as shown in FIGS. 9A-9B and 11A-11B. In another example, the planar surface of the circular flange segment can be at angle between 70° and 110° angle with the planar flange segment. In another example, the planar surface of the circular flange segment can be at angle between 80° and 100° angle with the planar flange segment. In an example the upper shutter can have a substantially uniform width. Each circular flange segment includes a chord edge 352D, 354D, 356D, and 358D. The CIUS chord edge 352D is substantially parallel to the COUS chord edge 354D from the open position to the closed position. The LIUS chord edge 356D is substantially parallel to the LOUS chord edge 358D from the open position to the closed position. Open refers to a substantially maximum distance between the chord edges of opposite facing upper shutters. Closed refers to a substantially minimum distance between the chord edges of opposite facing upper shutters. The upper shutters can be in multiple positions between the open and closed position. The upper shutters can vary in position between the open and closed position. The opening and closing of the shutters (including the lower shutters, the shutter bases, and the upper shutters) collimates the radiation (or other electromagnetic wave, such as visible light). The chord edges of the upper shutters can define the shape of the collimated area. FIG. 13A illustrates an open collimated area 392 with both the cross and long shutters in a fully open position, which can produce a maximum field size 216 (FIG. 2) of an emitted x-ray beam. FIG. 13B illustrates a closed collimated area 394 with both the cross and long shutters in a fully closed position, which can produce a minimum collimated field size 218 (FIG. 2) of an emitted x-ray beam or visible light.

The shutter base can have a similar outline and shape to the upper shutter in the area that overlaps with the upper shutter. The shutter base can include features to support the upper shutter, such as tabs in the web notch 353 and 359A. In an example, the upper shutter can include a radiation shielding or absorbing material and the shutter base includes a non-radiation shielding or absorbing material. In another example, both the upper shutter and shutter base include a radiation shielding or absorbing material.

In another example, the upper shutter can have a different shape or outline (as shown in FIGS. 3-15) so long at the cross upper shutters can overlap with the long upper shutters and the upper shutter provide a variable collimated area.

As illustrated in FIGS. 8A-9B, the CILS 332 is attached to the CISB 342, which is attached to the CIUS 352, and the COLS 334 is attached to the COSB 344, which is attached to the COUS 354. The sliding movement of the CILS control pin 362 on the cross control inner ramp 314 rotates or tilts the cross inner shutter about the CILS hinge pins 361A-B, which moves the CIUS chord edge 352D toward or away from the COUS chord edge 354D. Similarly, the sliding movement of the COLS control pin 364 on the cross control outer ramp 315 rotates or tilts the cross outer shutter about the COLS hinge pins 363A-B, which moves the COUS chord edge 354D toward or away from the CIUS chord edge 352D. The CIUS chord edge 352D can move toward or away from the COUS chord edge 354D simultaneously with movement of the cross shutter control 312.

As illustrated in FIGS. 10A-11B, the LILS 336 is attached to the long inner shutter base (LISB) 346, which is attached to the LIUS 356, and the LOLS 338 is attached to the long outer shutter base (LOSB) 348, which is attached to the LOUS 358. The sliding movement of the LILS control pin 366 on the long control inner ramp 324 rotates or tilts the long inner shutter about the LILS hinge pins 365A-B, which moves the LIUS chord edge 356D toward or away from the LOUS chord edge 358D. Similarly, the sliding movement of the LOLS control pin 368 on the long control outer ramp 325 rotates and tilts the cross outer shutter about the LOLS hinge pins 367A-B, which moves the LOUS chord edge 358D toward or away from the LIUS chord edge 356D. The LIUS chord edge 356D can move toward or away from the LOUS chord edge 358D simultaneously with movement of the long shutter control 322.

Adjacent upper shutters can have different heights (in the y-axis) to allow the shutters to overlap with each other. For example, the cross upper shutters 352 and 354 have a greater height than the long upper shutters 356 and 358, as shown in FIG. 13B.

Figure 14:
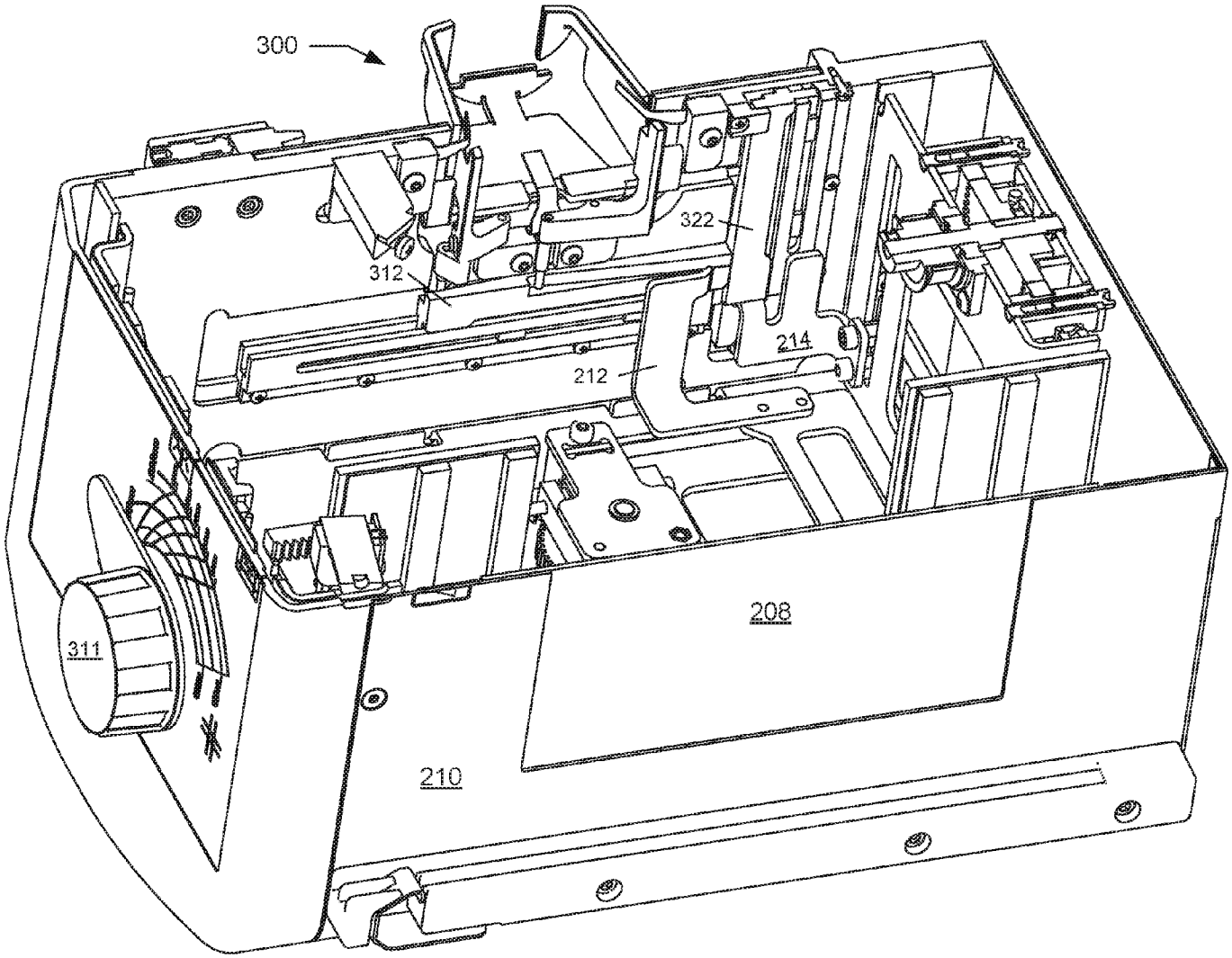
FIG. 14 illustrates a perspective cross-sectional bottom view of an example collimator.
Figure 15:
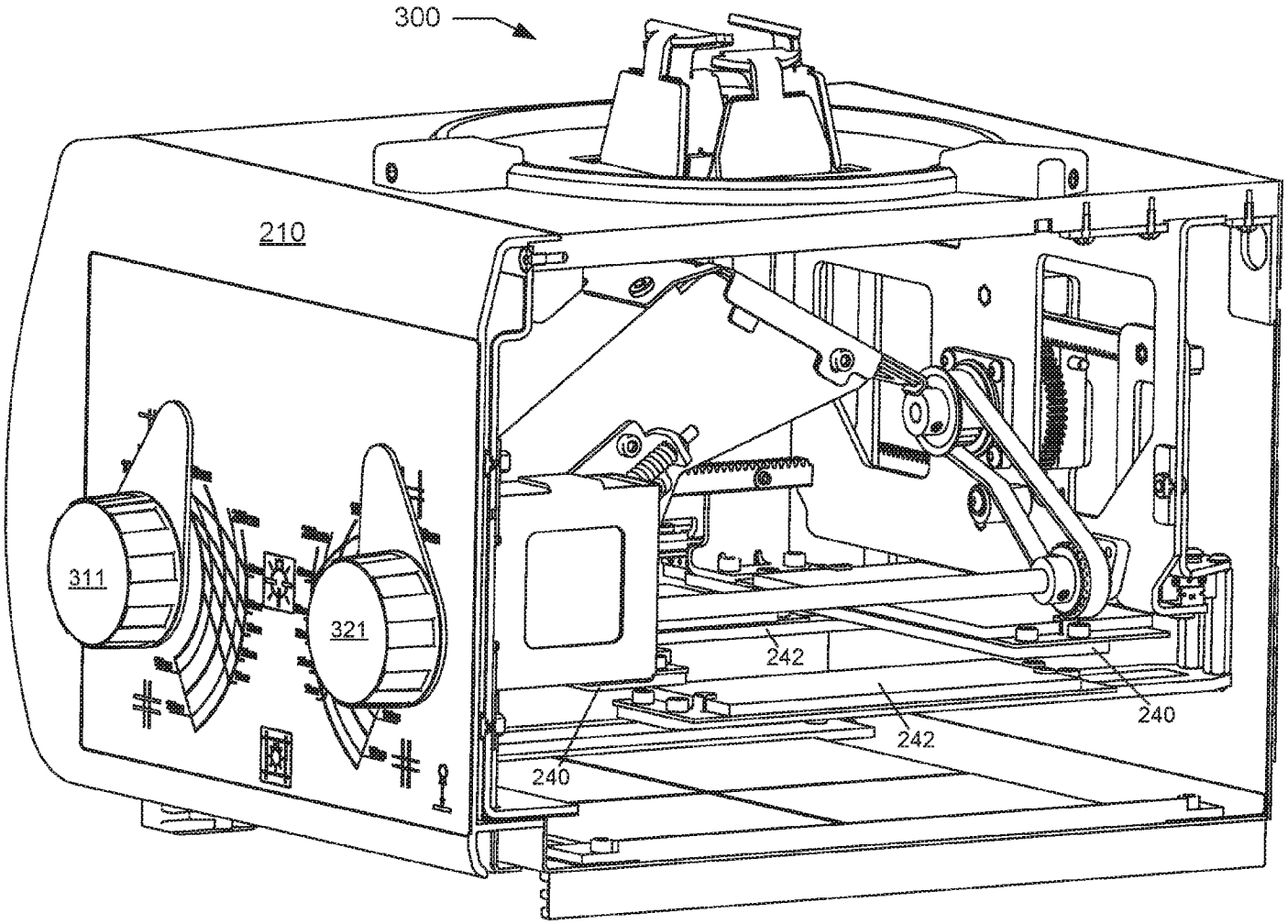
FIG. 15 illustrates a perspective cross-sectional side view of an example collimator.

FIGS. 14-15 illustrates perspective cross-sectional views of the mechanical features (e.g., gears, belts, and springs) that couples the collimator assembly 300 to the control dials or knobs 311 and 321. The mechanical features shown in FIGS. 14-15 are manually operated. In another example (not shown), the mechanical features are electrically driven. Various mechanism can be used to convert or translate the rotary movement of the control knobs into the linear motion for the shutter controls 312 and 322. FIGS. 2-3 and 14-15 illustrates control dials or knobs to adjust or move the shutter controls 312 and 322. In other examples, the controls for the shutter control can include sliding controls or slide controls (instead of control dials or knobs) or electronic controls to adjust or move the shutter controls 312 and 322 or other control device that allows multiple positions of the control.

Figure 16:
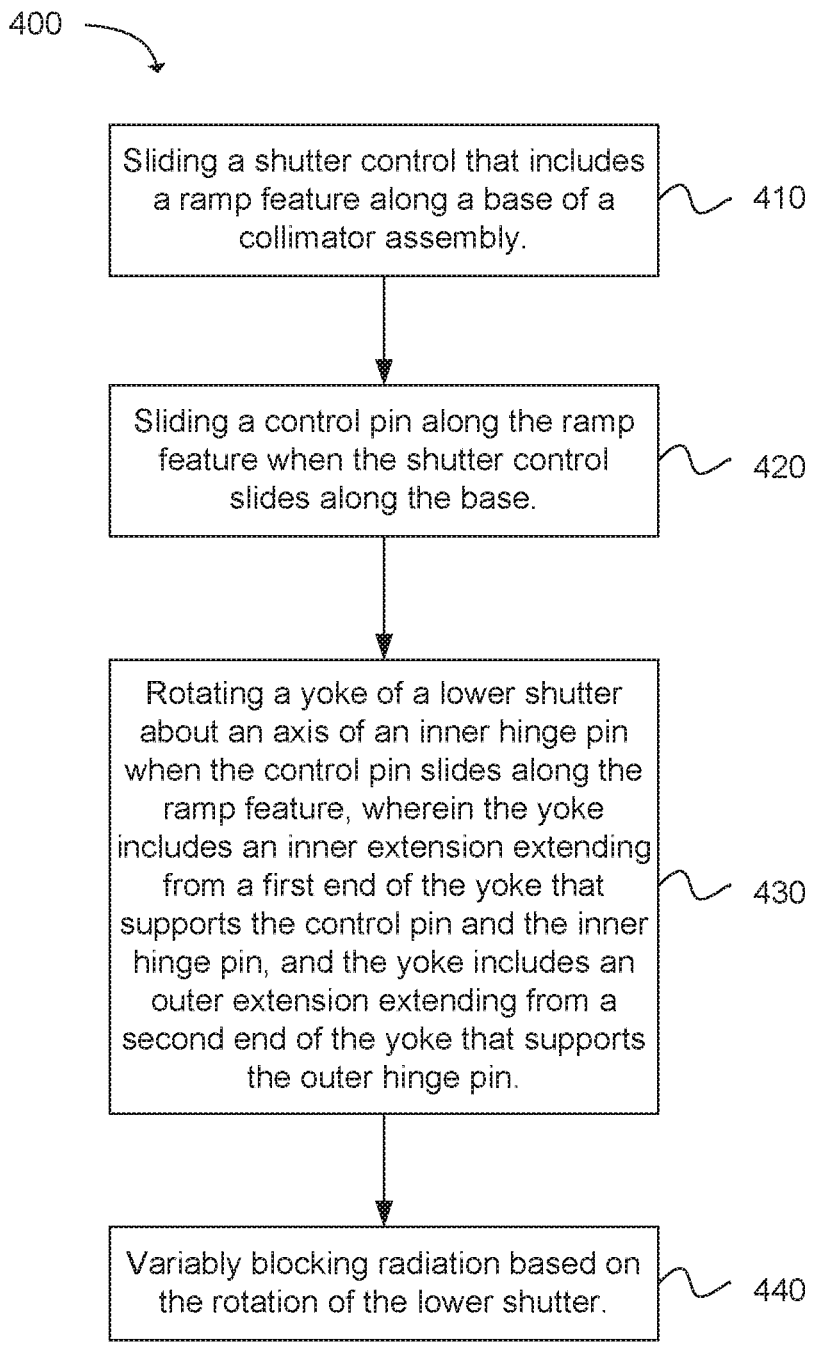
FIG. 16 is flowchart illustrating an example of a method of collimating radiation.

The flowchart shown in FIG. 16 illustrates a method 400 of collimating radiation. The method includes the step of sliding a shutter control that includes a ramp feature along a base of a collimator assembly, as in step 410. The step of sliding a control pin along the ramp feature when the shutter control slides along the base follows, as in step 420. The next step of the method includes rotating a yoke of a lower shutter about an axis of an inner hinge pin when the control pin slides along the ramp feature, where the yoke includes an inner extension extending from a first end of the yoke that supports the control pin and the inner hinge pin, and the yoke includes an outer extension extending from a second end of the yoke that supports the outer hinge pin, as in step 430. The method further includes the step of variably blocking radiation based on the rotation of the lower shutter, as in step 440.

The technology (systems, devices, assemblies, components, and methods) described herein can provide a collimator drive mechanism that includes a ramp with a specified slope or angle, which can be used to pivot a control pin up and down, where the control pin is coupled to a spring-loaded top shutter. The relatively long path of the control pin of the lower shutter on the ramp can be transformed to a small movement for the top shutter without using gears or similar mechanism in the collimator assembly. The collimator assembly allows simultaneous movement of the shutter pairs (including the upper shutter along with the lower shutter). The collimator assembly has a very compact design and profile, such as the height of the shutters, which provides a relatively small end product.

Reference throughout this specification to an "example" or an "embodiment" means that a particular feature, structure, or characteristic described in connection with the example is included in at least one embodiment of the invention. Thus, appearances of the words an "example" or an "embodiment" in various places throughout this specification are not necessarily all referring to the same embodiment.

Furthermore, the described features, structures, or characteristics may be combined in a suitable manner in one or more embodiments. In the following description, numerous specific details are provided (e.g., examples of layouts and designs) to provide a thorough understanding of embodiments of the invention. One skilled in the relevant art will recognize, however, that the invention can be practiced without one or more of the specific details, or with other methods, components, layouts, etc. In other instances, well-known structures, components, or operations are not shown or described in detail to avoid obscuring aspects of the invention.

While the forgoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited. Various features and advantages of the invention are set forth in the following claims.

What is claimed is:

1. A collimator assembly, comprising:

a base; and a shutter assembly including:

a lower shutter that includes:

a yoke, a control pin, and an inner extension extending from a first end of the yoke and supports the control pin; and a shutter control that includes a ramp feature that is slidably engaged with the control pin, wherein the yoke rotates as the control pin slides along the ramp feature, and the shutter control is slidably engaged with the base.

2. The collimator assembly of claim 1, wherein the shutter assembly further comprises:

a first shutter bracket attached to the base; and a second shutter bracket attached to the base;

wherein the lower shutter further comprises:

an outer extension extending from a second end of the yoke;

an outer hinge pin supported by the outer extension and the second shutter bracket, and the outer hinge pin is hingedly engaged with the outer extension or the second shutter bracket; and an inner hinge pin supported by the inner extension and the first shutter bracket, and the inner hinge pin is hingedly engaged with the inner extension or the first shutter bracket.

3. The collimator assembly of claim 2, wherein:

the base includes an opening;

the shutter assembly further comprises an upper shutter with a lower end that is in communication with the lower shutter, and a majority of the upper shutter has a substantially planar shape, wherein the upper shutter rotates with the rotation of the yoke of the lower shutter, and the rotation of the upper shutter is configured to variably block radiation from passing through the opening.

4. The collimator assembly of claim 3, wherein the upper shutter includes a circular segment extending from an end of the upper shutter furthest from the lower shutter and a chord of the circular segment is a furthest end of the upper shutter.

5. The collimator assembly of claim 3, wherein the shutter assembly further comprises:

a shutter base coupling the lower shutter to the upper shutter.

6. The collimator assembly of claim 3, wherein the lower shutter and the upper shutter include a radiation shielding material.

7. The collimator assembly of claim 6, wherein the radiation shielding material includes lead (Pb).

8. The collimator assembly of claim 3, wherein the shutter assembly further comprises:

a cantilever spring with a first end and a second end, and the first end is fixed in position by a middle bracket, and the second end applies a resilient force on the upper shutter or a shutter base coupling the lower shutter to the upper shutter.

9. The collimator assembly of claim 8, wherein the lower shutter includes a notch in the yoke, wherein the notch allows rotation of the lower shutter without applying a direct force on the cantilever spring by the lower shutter.

10. The collimator assembly of claim 2, wherein the shutter assembly further comprises:

a second lower shutter further comprising:

a second yoke, a second control pin, an inner extension extending from a first end of the second yoke and supports second control pin, a second inner hinge pin supported by the inner extension of the second yoke and the first shutter bracket, and the second inner hinge pin is hingedly engaged with the inner extension of the second yoke or the first shutter bracket, an outer extension extending from a second end of the second yoke, and a second outer hinge pin supported by the outer extension of the second yoke and second shutter bracket, and the second outer hinge pin is hingedly engaged with the outer extension of the second yoke or the second shutter bracket; and wherein a length of the yoke is substantially parallel to a length of the second yoke; and wherein the shutter control includes a second ramp feature that is slidably engaged with the second control pin, the second yoke rotates as the second control pin slides along the second ramp feature, and the rotation of the yoke is in an opposite direction as the rotation of the second yoke.

11. The collimator assembly of claim 10, wherein the shutter assembly further comprises:

a first upper shutter with a lower end that is in communication with the lower shutter, and a majority of the first upper shutter has a substantially planar shape, wherein the first upper shutter rotates with the rotation of the lower shutter, and the rotation of the first upper shutter is configured to variably block radiation from passing through an opening in the base;

a second upper shutter with a lower end that is in communication with the second lower shutter, and a majority of the second upper shutter has a substantially planar shape, wherein the second upper shutter rotates with a rotation of the second lower shutter, and the rotation of the second upper shutter is configured to variably block radiation from passing through the opening; and wherein slideable movement of the shutter control changes a distance between an upper end of the first upper shutter and an upper end of the second upper shutter.

12. The collimator assembly of claim 10, wherein the lower shutter, the second lower shutter, and the shutter control form a first shutter assembly pair, and further comprising:

a second shutter assembly pair comprising:

a third lower shutter that includes a third yoke and a third control pin, a fourth lower shutter that includes a fourth yoke and a fourth control pin, and a second shutter control that includes a third ramp feature that is slidably engaged with the third control pin and a fourth ramp feature that is slidably engaged with the fourth control pin, and the second shutter control is slidably engaged with the base, wherein the third yoke rotates as the third control pin slides along the third ramp feature and the fourth yoke rotates as the fourth control pin slides along the fourth ramp feature, and the rotation of the third yoke is in an opposite direction as the rotation of the fourth yoke.

13. The collimator assembly of claim 12, wherein:

the length of the lower shutter and the second lower shutter are substantially perpendicular to a length of the third lower shutter and the fourth lower shutter, and a length of the shutter control is substantially perpendicular to a length of the second shutter control, and the lower shutter, the second lower shutter, the third lower shutter, and the fourth lower shutter form sides of a substantially rectangular shape.

14. The collimator assembly of claim 13, wherein a portion of the lower shutter and the second lower shutter overlap a portion of the third lower shutter and the fourth lower shutter.

15. The collimator assembly of claim 1, wherein the shutter assembly further comprises:

a control guide attached to the base that substantially confines movement of the shutter control to a single axis.

16. The collimator assembly of claim 15, wherein the control guide includes an elongated slot and the shutter control includes at least one protrusion slidably engaged in the elongated slot, and the at least one protrusion limits movement of the shutter control in the single axis.

17. A method of collimating radiation, the method comprising:

sliding a shutter control that includes a ramp feature along a base of a collimator assembly;

sliding a control pin along the ramp feature when the shutter control slides along the base;

rotating a yoke of a lower shutter about an axis of an inner hinge pin when the control pin slides along the ramp feature, wherein the yoke includes an inner extension extending from a first end of the yoke that supports the control pin and the inner hinge pin, and the yoke includes an outer extension extending from a second end of the yoke that supports an outer hinge pin; and variably blocking radiation based on the rotation of the lower shutter.

18. The method of claim 17, wherein rotating the yoke of the lower shutter rotates an upper shutter extending from the lower shutter, wherein the upper shutter includes a radiation shielding material and provides greater variation in blocking radiation than the lower shutter alone.

19. The method of claim 18, further comprising:

applying a resilient force from the base to the upper shutter via a cantilever spring;

forcing the control pin down onto the ramp feature when the resilient force is applied to the upper shutter.

20. A collimator assembly, comprising:

a base including an opening;

two shutter controls;

four shutter brackets;

four shutter assemblies, wherein each shutter assembly is located on one of four sides of the opening and each shutter assembly includes:

a lower shutter that includes:

a yoke, a control pin, an inner hinge pin, an inner extension extending from a first end of the yoke and supports the control pin and the inner hinge pin, an outer hinge pin, and an outer extension extending from a second end of the yoke and supports the outer hinge pin; and wherein two opposing shutter assemblies provide a shutter assembly pair, and one shutter assembly pair is substantially perpendicular to another shutter assembly pair;

wherein control pins of lower shutters of each shutter assembly pair are silidably engaged with separate ramp features of one of the two shutter controls, and each yoke rotates as a corresponding control pin slides along a corresponding ramp feature; and wherein the inner hinge pins of the lower shutters of each shutter assembly pair are supported by an inner shutter bracket that is one of the four shutter brackets, and the outer hinge pins of the lower shutters of each shutter assembly pair are supported by an outer shutter bracket that is one of the four shutter brackets, and each inner hinge pin is hingedly engaged with the inner extension or the inner shutter bracket, and each outer hinge pin is hingedly engaged with the outer extension or the outer shutter bracket.

21. The collimator assembly of claim 20, wherein each shutter assembly further comprises an upper shutter that is in communication with the lower shutter, wherein the upper shutter rotates with the rotation of the lower shutter, and the rotation of the upper shutter is configured to variably block radiation from passing through the opening.

* * * * *